US008483445B2

(12) United States Patent
Tjhang et al.

(10) Patent No.: US 8,483,445 B2
(45) Date of Patent: Jul. 9, 2013

(54) IMAGING METHODS AND SYSTEMS FOR DOWNHOLE FLUID ANALYSIS

(75) Inventors: Theodorus Tjhang, Sagamihara (JP); Osamu Osawa, Tokyo (JP); Yutaka Imasato, Chiba (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 164 days.

(21) Appl. No.: 13/245,827

(22) Filed: Sep. 26, 2011

(65) Prior Publication Data

US 2012/0076364 A1 Mar. 29, 2012

Related U.S. Application Data

(60) Provisional application No. 61/387,468, filed on Sep. 29, 2010.

(51) Int. Cl.
*G06K 9/00* (2006.01)

(52) U.S. Cl.
USPC ..... 382/109

(58) Field of Classification Search
USPC ..... 382/109
See application file for complete search history.

(56) References Cited

U.S. PATENT DOCUMENTS

| | | | | |
|---|---|---|---|---|
| 3,780,575 | A | 12/1973 | Urbanosky | |
| 3,859,851 | A | 1/1975 | Urbanosky | |
| 5,140,319 | A | 8/1992 | Riordan | |
| 5,663,559 | A | 9/1997 | Auzerais et al. | |
| 5,859,430 | A * | 1/1999 | Mullins et al. | 250/255 |
| 7,114,562 | B2 | 10/2006 | Fisseler et al. | |
| 7,423,258 | B2 * | 9/2008 | DiFoggio et al. | 250/269.1 |
| 7,461,547 | B2 * | 12/2008 | Terabayashi et al. | 73/152.55 |
| 7,511,813 | B2 * | 3/2009 | Vannuffelen et al. | 356/328 |
| 7,675,029 | B2 | 3/2010 | Ramstad et al. | |
| 8,023,690 | B2 * | 9/2011 | DiFoggio et al. | 382/100 |
| 8,274,400 | B2 * | 9/2012 | Wilson et al. | 340/854.9 |
| 2007/0035736 | A1 | 2/2007 | Vannuffelen et al. | |

FOREIGN PATENT DOCUMENTS

| | | |
|---|---|---|
| EP | 0643198 B1 | 11/2000 |
| WO | 99/44367 | 9/1999 |

OTHER PUBLICATIONS

International Search Report for the equivalent international patent application No. PCT/IB2011/002265 issued on Apr. 2, 2013.

M. Ishikawa et al., "A CMOS Vision Chip with SIMD Processing Element Array for 1ms Image Processing", 1999 IEEE International Solid-State Circuits Conference (ISSCC 1999), Session 12, Paper TP 12.2, Digest of Technical. Papers, pp. 206-207.

(Continued)

*Primary Examiner* — Tom Y Lu

(74) *Attorney, Agent, or Firm* — Jianguang Du; Jody DeStefanis

(57) ABSTRACT

An example system described herein to perform downhole fluid analysis includes an imaging processor to be positioned downhole in a geological formation, the imaging processor including a plurality of photo detectors to sense light that has contacted a formation fluid in the geological formation, each photo detector to determine respective image data for a respective portion of an image region supported by the imaging processor, and a plurality of processing elements, each processing element being associated with a respective photo detector and to process first image data obtained from the respective photo detector and second image data obtained from at least one neighbor photo detector, and a controller to report measurement data via a telemetry communication link to a receiver to be located outside the geological formation, the measurement data being based on processed data obtained from the plurality of processing elements.

30 Claims, 15 Drawing Sheets

OTHER PUBLICATIONS

A. R. Smits et al., "In-Situ Optical Fluid Analysis as an Aid to Wireline Formation Sampling", SPE Formation Evaluation, pp. 91-98, Jun. 1995.

Idaku Ishii and Masatoshi Ishikawa, "Self Windowing for High Speed Vision", Proceedings of the 1999 IEEE, International Conference on Robotics & Automation, Detroit, Michigan, May 1999, pp. 1916-1921.

Chengli Dong et al, Downhole Measurement of Methane Content and GOR in Formation Fluid Samples, SPE Reservoir Evaluation & Engineering, Feb. 2006, pp. 7-13.

Oku et al. "High-speed autofocusing of a cell using diffraction patterns", Optics Express 3952, vol. 14, No. 9, May 1, 2006, pp. 3952-3960.

* cited by examiner

IMAGING METHODS AND SYSTEMS FOR DOWNHOLE FLUID ANALYSIS

RELATED APPLICATION(S)

This patent claims priority from U.S. Provisional Application Ser. No. 61/387,468, entitled "Downhole Fluid Analysis Using High Speed Imaging System" and filed on Sep. 29, 2010. U.S. Provisional Application Ser. No. 61/387,468 is hereby incorporated by reference in its entirety.

FIELD OF THE DISCLOSURE

This disclosure relates generally to image processing and, more particularly, to imaging methods and systems for downhole fluid analysis.

BACKGROUND

Downhole fluid analysis is a useful and efficient investigative technique for ascertaining characteristics of geological formations having hydrocarbon deposits. For example, downhole fluid analysis can be used during oilfield exploration and development to determine petrophysical, mineralogical, and fluid properties of hydrocarbon reservoirs. Such fluid characterization can be integral to accurately evaluating the economic viability of a particular hydrocarbon reservoir formation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Example methods and systems disclosed herein relate generally to image processing and, more particularly, to image processing for downhole fluid analysis. An example system to perform downhole fluid analysis disclosed herein includes an example imaging processor to be positioned downhole in a geological formation. The example imaging processor includes a plurality of photo detectors to sense light that has contacted a formation fluid in the geological formation. In the example system, each photo detector is to determine respective image data for a respective portion of an image region supported by imaging processor. The example imaging processor also includes a plurality of processing elements. In the example system, each processing element is associated with a respective photo detector and is to process first image data obtained from the respective photo detector and second image data obtained from at least one neighbor photo detector. The example system further includes an example controller to report measurement data via a telemetry communication link to a receiver to be located outside the geological formation. In the example system, the measurement data is based on processed data obtained from the plurality of processing elements.

An example method for performing downhole fluid analysis disclosed herein includes sensing light that has contacted a formation fluid in a geological formation using a plurality of photo detectors positioned downhole in the geological formation. In the example method, each photo detector determines respective image data for a respective portion of an image region defined by the plurality of photo detectors. The example method also includes processing the image data determined by the plurality of photo detectors using a plurality of processing elements positioned downhole in the geological formation. In the example method, each processing element processes first image data obtained from a respective photo detector associated with the processing element and second image data obtained from at least one neighbor photo detector. The example method further includes sending measurement data via a telemetry communication link to a receiver located outside the geological formation. In the example method, the measurement data is based on processed data obtained from the plurality of processing elements.

An example tangible article of manufacture disclosed herein stores example machine readable instructions which, when executed, cause a machine to at least sense light that has contacted a formation fluid in a geological formation using a plurality of photo detectors positioned downhole in the geological formation. For example, each photo detector is to determine respective image data for a respective portion of an image region defined by the plurality of photo detectors. The example machine readable instructions, when executed, also cause the machine to process the image data determined by the plurality of photo detectors using a plurality of processing elements positioned downhole in the geological formation. For example, each processing element is to process first image data obtained from a respective photo detector associated with the processing element and second image data obtained from at least one neighbor photo detector. The example machine readable instructions, when executed, further cause the machine to send measurement data via a telemetry communication link to a receiver located outside the geological formation. For example, the measurement data is based on processed data obtained from the plurality of processing elements.

BRIEF DESCRIPTION OF THE DRAWINGS

Example imaging methods and systems for downhole fluid analysis are described with reference to the following figures. Where possible, the same numbers are used throughout the figures to reference like features and components.

DETAILED DESCRIPTION

Figure 1:
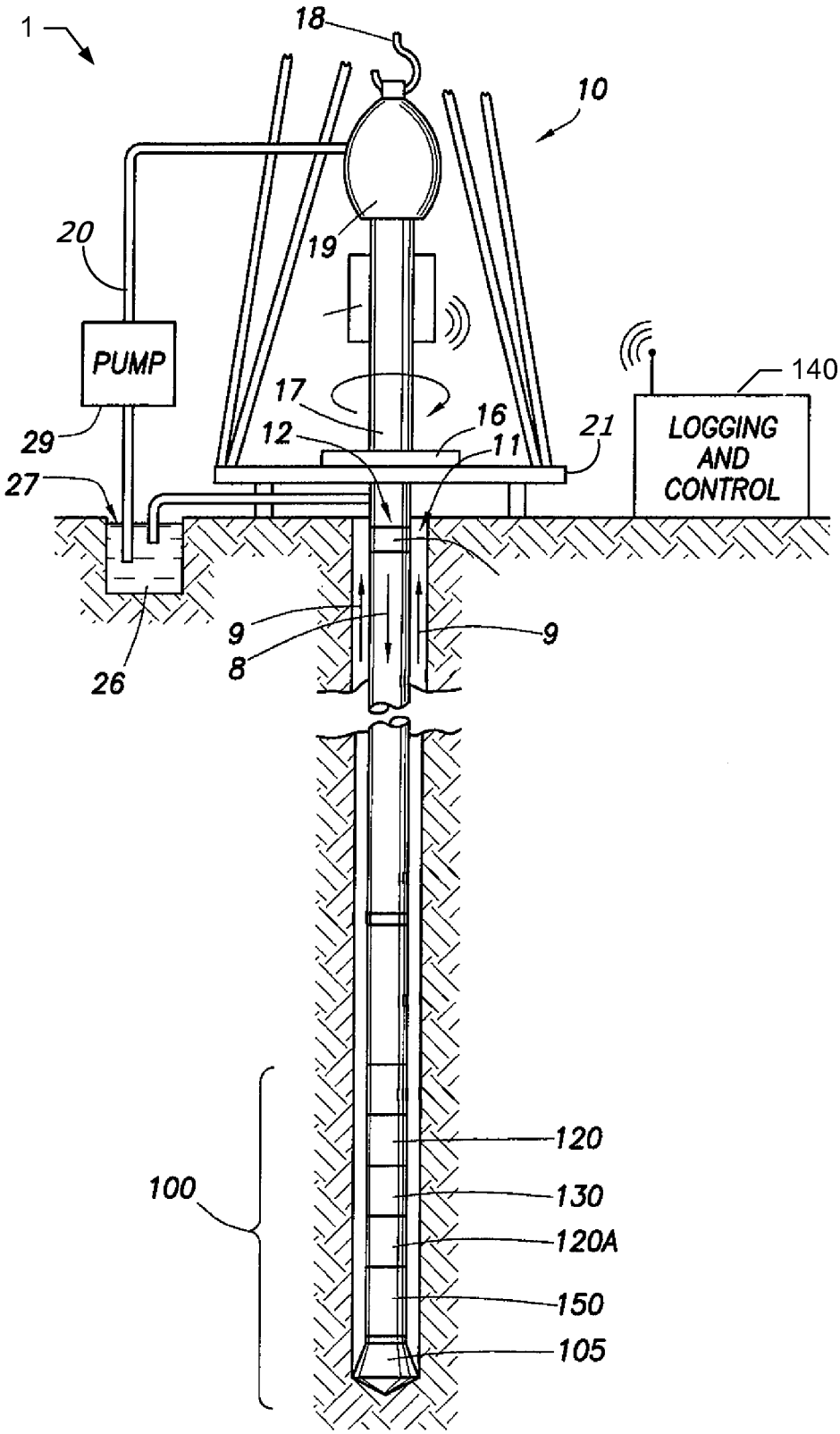
FIG. 1 is a block diagram illustrating an example wellsite system capable of supporting the example imaging methods, apparatus and articles of manufacture for downhole fluid analysis disclosed herein.

In the following detailed description, reference is made to the accompanying drawings, which form a part hereof, and within which are shown by way of illustration specific embodiments by which the invention may be practiced. It is to be understood that other embodiments may be utilized and structural changes may be made without departing from the scope of the disclosure.

Example imaging methods and systems for downhole fluid analysis are disclosed herein. A complex mixture of fluids, such as oil, gas, and water, may be found downhole in reservoir formations. The downhole fluids, which are also referred to herein as formation fluids, have characteristics including pressure, temperature, volume, and/or other fluid properties that determine phase behavior of the various constituent elements of the fluids. To evaluate underground formations surrounding a borehole, some prior fluid analysis techniques obtain samples of formation fluids in the borehole for purposes of characterizing the fluids, such as by determining composition analysis, fluid properties and phase behavior. Some wireline formation testing tools are described, for example, in U.S. Pat. Nos. 3,780,575 and 3,859,851. The Reservoir Formation Tester (RFT) and Modular Formation Dynamics Tester (MDT) of Schlumberger are further examples of sampling tools for extracting samples of formation fluids from a borehole for surface analysis.

Formation fluids under downhole conditions of composition, pressure and temperature may be different from the fluids at surface conditions. For example, downhole temperatures in a well could be approximately 300 degrees Fahrenheit. When samples of downhole fluids are transported to the surface, the fluids tend to change temperature, and exhibit attendant changes in volume and pressure. The changes in the fluids as a result of transportation to the surface cause phase separation between gaseous and liquid phases in the samples, and changes in compositional characteristics of the formation fluids.

Recent developments in downhole fluid analysis include techniques for characterizing formation fluids downhole in a wellbore or borehole. For example, a more recent MDT may include one or more fluid analysis modules, such as the composition fluid analyzer (CFA) and live fluid analyzer (LFA) of Schlumberger, to analyze downhole fluids sampled by the tool while the fluids are still located downhole.

In the prior downhole fluid analysis modules described above, formation fluids that are to be analyzed downhole flow past a sensor module, such as a spectrometer module, associated with the fluid analysis module, which analyzes the flowing fluids using, for example, infrared absorption spectroscopy. Additionally, an optical fluid analyzer (OFA), which may be located in the fluid analysis module, may identify fluids in the flow stream and quantify the oil and water content. Furthermore, U.S. Patent Publication No. 2007/0035736, and U.S. Pat. Nos. 5,663,559, 7,675,029 and 5,140,319 describe implementations of downhole video imaging or spectral video imaging for the characterization of formation fluid samples, as well as during flow-through production tubing, including subsea flow lines. U.S. Patent Publication No. 2007/0035736, and U.S. Pat. Nos. 5,663,559, 7,675,029 and 5,140,319 are incorporated herein by reference in their respective entireties.

After the prior tools described above take measurements of formation fluids downhole, the measurements are often converted into a suitable form for transmission to the surface via a telemetry system. However, a typical telemetry system for use in an oilfield environment has a relatively small bandwidth and, thus, can support just relatively low-speed data transmission for communicating the measurements to the surface. Therefore, if the measurements were to include images from a downhole two-dimensional sensor or camera, such images might contain large amount of data that could not be sent to the surface in a reasonable time due to the relatively low-speed data transmission of the telemetry system.

Accordingly, there is a need to transmit meaningful downhole fluid analysis data using existing telemetry systems that have relatively small bandwidths. Unlike prior downhole fluid analysis system, example imaging methods, systems and articles of manufacture disclosed herein for downhole fluid analysis are able to support advanced image processing downhole such that meaningful measurement results can be determined downhole and can be reported in real-time to the surface using existing telemetry systems having relatively small bandwidths.

Turning to the figures, FIG. 1 illustrates an example wellsite system 1 in which the example imaging methods, systems and articles of manufacture disclosed herein for downhole fluid analysis can be employed. The wellsite can be onshore or offshore. In this example system, a borehole 11 is formed in subsurface formations by rotary drilling, whereas other example systems can use directional drilling.

A drillstring 12 is suspended within the borehole 11 and has a bottom hole assembly 100 that includes a drill bit 105 at its lower end. The surface system includes platform and derrick assembly 10 positioned over the borehole 11, the assembly 10 including a rotary table 16, kelly 17, hook 18 and rotary swivel 19. In an example, the drill string 12 is suspended from a lifting gear (not shown) via the hook 18, with the lifting gear being coupled to a mast (not shown) rising above the surface. An example lifting gear includes a crown block whose axis is affixed to the top of the mast, a vertically traveling block to which the hook 18 is attached, and a cable passing through the crown block and the vertically traveling block. In such an example, one end of the cable is affixed to an anchor point, whereas the other end is affixed to a winch to raise and lower the hook 18 and the drillstring 12 coupled thereto. The drillstring 12 is formed of drill pipes screwed one to another.

The drillstring 12 may be raised and lowered by turning the lifting gear with the winch. In some scenarios, drill pipe raising and lowering operations require the drillstring 12 to be unhooked temporarily from the lifting gear. In such scenarios, the drillstring 12 can be supported by blocking it with wedges in a conical recess of the rotary table 16, which is mounted on a platform 21 through which the drillstring 12 passes.

In the illustrated example, the drillstring 12 is rotated by the rotary table 16, energized by means not shown, which engages the kelly 17 at the upper end of the drillstring 12. The drillstring 12 is suspended from the hook 18, attached to a traveling block (also not shown), through the kelly 17 and the rotary swivel 19, which permits rotation of the drillstring 12 relative to the hook 18. In some examples, a top drive system could be used.

In the illustrated example, the surface system further includes drilling fluid or mud 26 stored in a pit 27 formed at the well site. A pump 29 delivers the drilling fluid 26 to the interior of the drillstring 12 via a hose 20 coupled to a port in the swivel 19, causing the drilling fluid to flow downwardly through the drillstring 12 as indicated by the directional arrow 8. The drilling fluid exits the drillstring 12 via ports in the drill bit 105, and then circulates upwardly through the annulus region between the outside of the drillstring and the wall of the borehole, as indicated by the directional arrows 9. In this manner, the drilling fluid lubricates the drill bit 105 and carries formation cuttings up to the surface as it is returned to the pit 27 for recirculation.

The bottom hole assembly 100 includes one or more specially-made drill collars near the drill bit 105. Each such drill collar has one or more logging devices mounted on or in it, thereby allowing downhole drilling conditions and/or various characteristic properties of the geological formation (e.g., such as layers of rock or other material) intersected by the borehole 11 to be measured as the borehole 11 is deepened. In particular, the bottom hole assembly 100 of the illustrated example system 1 includes a logging-while-drilling (LWD) module 120, a measuring-while-drilling (MWD) module 130, a roto-steerable system and motor 150, and the drill bit 105.

The LWD module 120 is housed in a drill collar and can contain one or a plurality of logging tools. It will also be understood that more than one LWD and/or MWD module can be employed, e.g. as represented at 120A. (References, throughout, to a module at the position of 120 can mean a module at the position of 120A as well.) The LWD module 120 includes capabilities for measuring, processing, and storing information, as well as for communicating with the surface equipment.

The MWD module 130 is also housed in a drill collar and can contain one or more devices for measuring characteristics of the drillstring 12 and drill bit 105. The MWD module 130 further includes an apparatus (not shown) for generating electrical power to the downhole system. This may include a mud turbine generator powered by the flow of the drilling fluid, it being understood that other power and/or battery systems may be employed. In the illustrated example, the MWD module 130 includes one or more of the following types of measuring devices: a weight-on-bit measuring device, a torque measuring device, a vibration measuring device, a shock measuring device, a stick slip measuring device, a direction measuring device, and an inclination measuring device.

The wellsite system 1 also includes a logging and control unit 140 communicably coupled in any appropriate manner to the LWD module 120/120A and the MWD module 130. In the illustrated example, the LWD module 120/120A and/or the MWD module 130 include(s) an example downhole fluid analyzer as described in greater detail below to perform downhole fluid analysis in accordance with the example methods, apparatus and articles of manufacture disclosed herein. The downhole fluid analyzer included in the LWD module 120/120A and/or the MWD module 130 reports the measurement results for the downhole fluid analysis to the logging and control unit 140. Example downhole fluid analyzers that may be included in and/or implemented by the LWD module 120/120A and/or the MWD module 130 are described in greater detail below.

Figure 2:
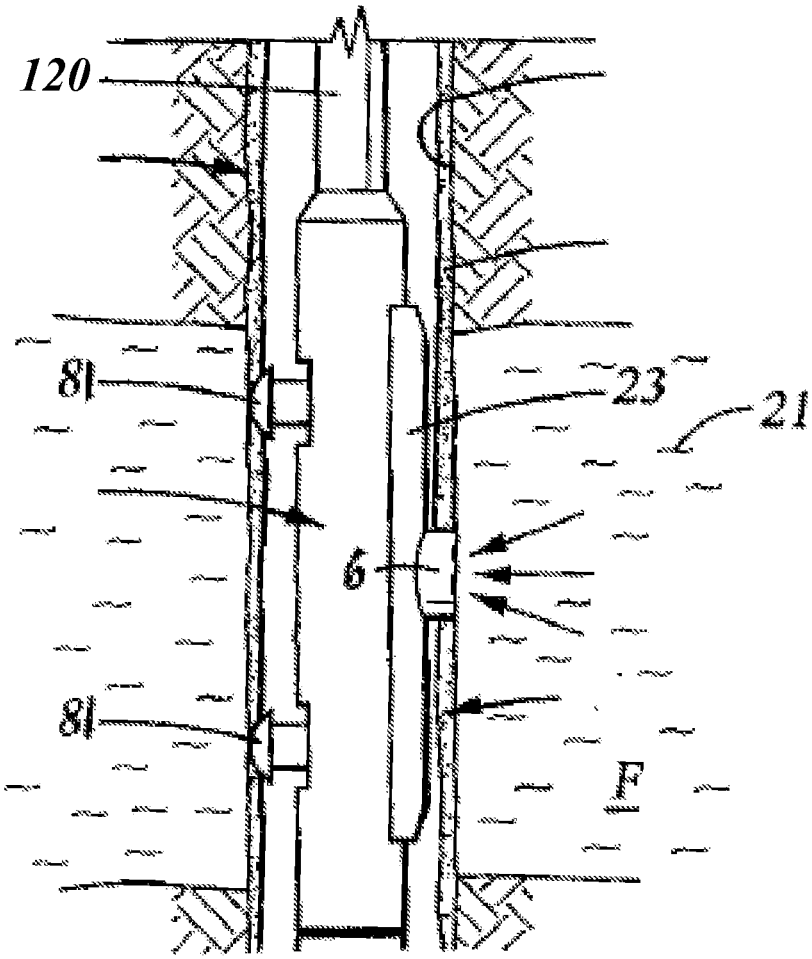
FIG. 2 is a block diagram illustrating a prior sampling-while-drilling logging device.

FIG. 2 is a simplified diagram of a prior sampling-while-drilling logging device of a type described in U.S. Pat. No. 7,114,562, incorporated herein by reference, utilized as the LWD tool 120 or part of an LWD tool suite 120A. The LWD tool 120 is provided with a probe 6 for establishing fluid communication with the formation and drawing the fluid 21 into the tool, as indicated by the arrows. The probe may be positioned in a stabilizer blade 23 of the LWD tool and extended therefrom to engage the borehole wall. The stabilizer blade 23 comprises one or more blades that are in contact with the borehole wall. Fluid drawn into the downhole tool using the probe 6 may be measured to determine, for example, pretest and/or pressure parameters. Additionally, the LWD tool 120 may be provided with devices, such as sample chambers, for collecting fluid samples for retrieval at the surface. Backup pistons 81 may also be provided to assist in applying force to push the drilling tool and/or probe against the borehole wall.

Figure 3:
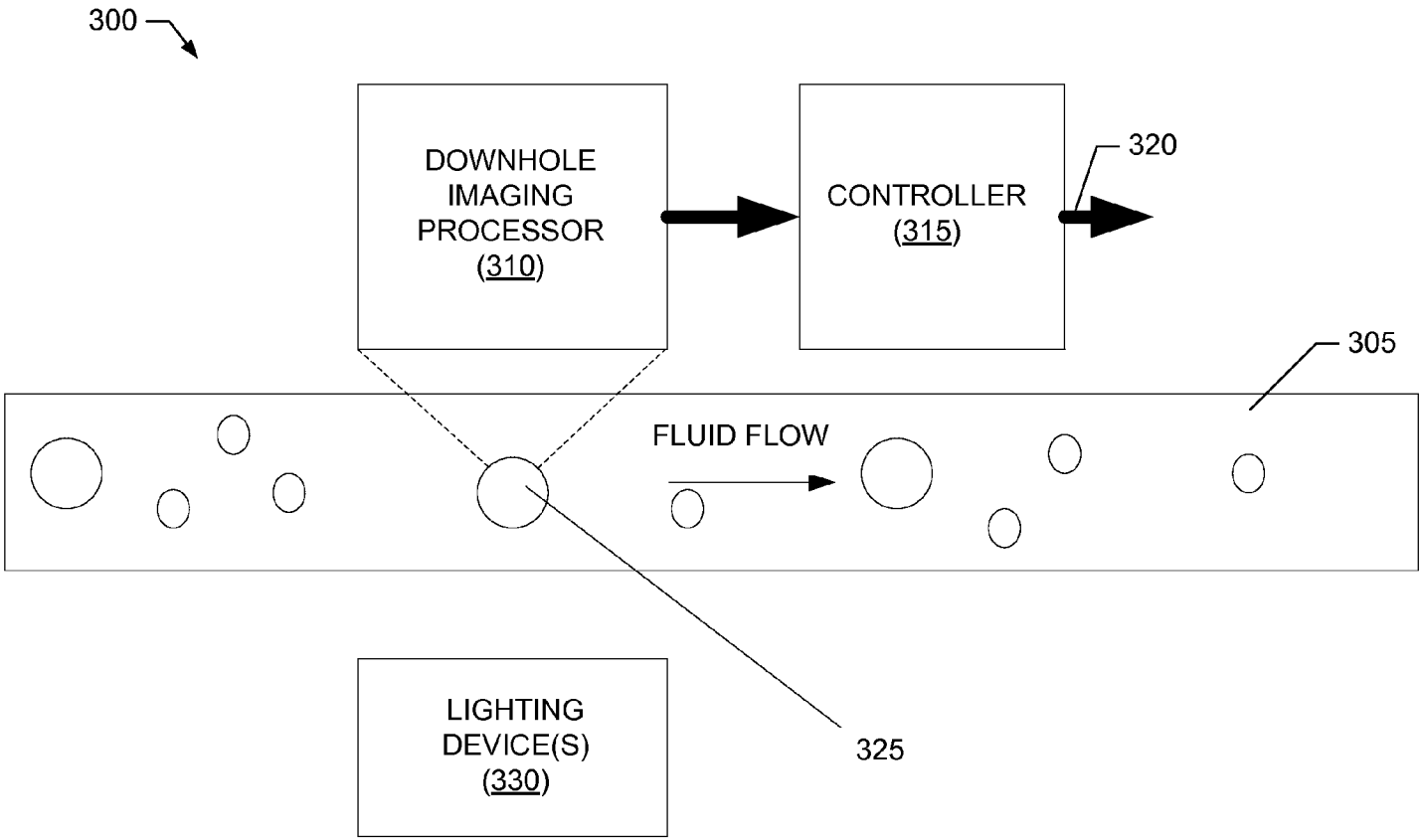
FIG. 3 illustrates a first example downhole fluid analyzer employing a pass-through light source that may be used to perform downhole fluid analysis in the wellsite system of FIG. 1.

An example downhole fluid analyzer 300 that may be used to implement imaging-based downhole fluid analysis in the wellsite system 1 in accordance the example methods, systems and articles of manufacture disclosed herein is illustrated in FIG. 3. The downhole fluid analyzer 300 senses light that has contacted the formation fluid 305 in a geological formation and relies on image processing of the sensed light to perform downhole fluid analysis, unlike the prior tool of FIG. 2 that physically samples the formation fluid. Furthermore, rather than collecting fluid samples for transmission to the surface for analysis, the downhole fluid analyzer 300 includes an example downhole imaging processor 310 that can be positioned downhole in a borehole or wellbore in the formation to perform light sensing and high-speed (e.g., real-time) image processing of the sensed image data locally (e.g., downhole) where the formation fluid being analyzed is located. The formation fluid 305 can include one or more gaseous, liquid and/or solid phases, such as, for example, water, oil, gas, flowable solid material, etc.

For example, and as described in greater detail below, the downhole imaging processor 310 includes an array of photo detectors to determine image data by sensing light that has contacted the formation fluid 305. The downhole imaging processor 310 further includes an array of processing elements associated with the array of photo detectors to process the image data to determine, for example, object boundary information for an object 325 (e.g., such as a bubble, a sand particle, etc.) in the formation fluid 305. Example implementations of the downhole imaging processor 310 are described in greater detail below.

In the illustrated example, the processed image data determined by the downhole imaging processor 310 is further processed and formatted by an example controller 315 to determine downhole fluid analysis measurement data to be reported via an example telemetry communication link 320 to a receiver, such as the logging and control unit 140, located on the surface or otherwise outside the geological formation. For example, the controller 315 can process object boundary information determined by the downhole imaging processor 310 to determine a number of objects 325 in the formation fluid 305, location(s) of object(s) 325 in the formation fluid 305, size(s) of object(s) 325 in the formation fluid 305, etc., or any combination thereof. The controller 315 can, for example, compress, encrypt, modulate and/or filter the processed data obtained from the downhole imaging processor 310 to format the data for reporting via the telemetry communication link 320. Example implementations of the controller 315 are described in greater detail below.

Because the downhole fluid analyzer 300 performs the bulk of its processing downhole and reports just a relatively small amount of measurement data up to the surface, the downhole fluid analyzer 300 can provide high-speed (e.g., real time) fluid analysis measurements using a relatively low bandwidth telemetry communication link 320. As such, the telemetry communication link 320 can be implemented by almost any type of communication link, even existing telemetry links used today, unlike other prior downhole fluid analysis techniques that require high-speed communication links to transmit high-bandwidth image and/or video signals to the surface.

In the illustrated example of FIG. 3, the downhole fluid analyzer 300 is configured to support penetration-type lighting of the formation fluid 305 being analyzed. As such, the downhole fluid analyzer 300 includes one or more example lighting devices 330 positioned to cause the light to pass through the formation fluid 305 for sensing by the downhole imaging processor 310. For example, the downhole fluid analyzer 300 can include a sample cell (not shown) positionable to be in fluid communication with the formation fluid 305. In the illustrated example of FIG. 3, the downhole imaging processor 310 could be located on one side of the sample cell and the lighting device(s) 330 could be located on another side of the sample cell. In such an example, the sample cell includes a first substantially transparent window to permit light emitted by the lighting device(s) 330 to pass through the window and penetrate the formation fluid 305. The sample cell in such an example also includes a second substantially transparent window to permit the light passing through the formation fluid 305 to be sensed by the downhole imaging processor 310.

Figure 4:
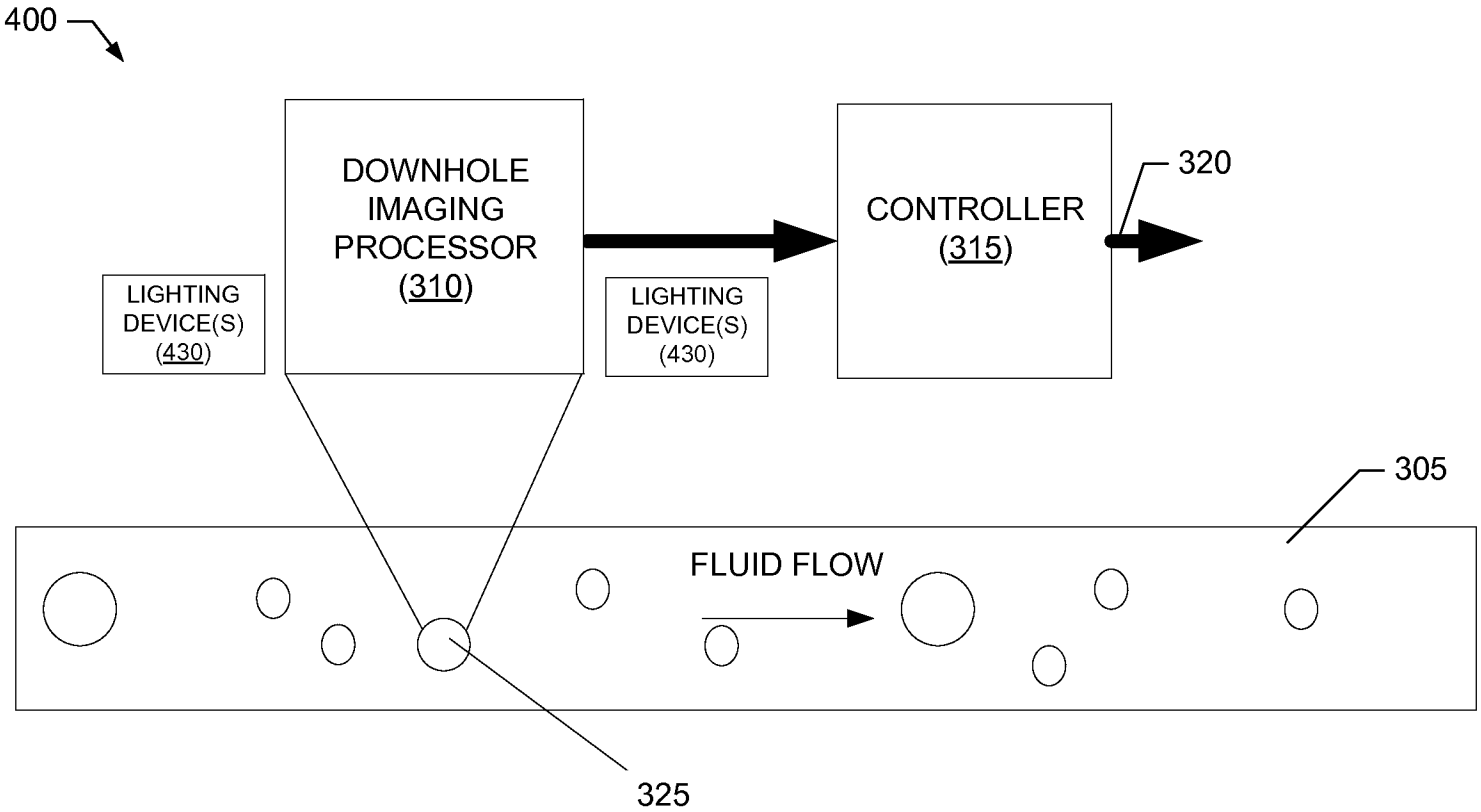
FIG. 4 illustrates a second example downhole fluid analyzer employing a reflective light source that may be used to perform downhole fluid analysis in the wellsite system of FIG. 1.

A second example downhole fluid analyzer 400 that may be used to implement imaging-based downhole fluid analysis in the wellsite system 1 in accordance the example methods, systems and articles of manufacture disclosed herein is illustrated in FIG. 4. The second example downhole fluid analyzer 400 includes many elements, such as the downhole imaging processor 310, the controller 315 and the telemetry communication link 320, in common with the first example downhole fluid analyzer 300 of FIG. 3. As such, like elements in FIGS. 3 and 4 are labeled with the same reference numerals. The detailed descriptions of these like elements are provided above in connection with the discussion of FIG. 3 and, in the interest of brevity, are not repeated in the discussion of FIG. 4.

In the illustrated example of FIG. 4, the downhole fluid analyzer 400 is configured to support reflection-type lighting of the formation fluid 305 being analyzed. As such, the downhole fluid analyzer 400 includes one or more example lighting devices 430 positioned to cause light to be reflected by the formation fluid 305 for sensing by the downhole imaging processor 310. For example, the downhole fluid analyzer 400 can include a sample cell (not shown) positionable to be in fluid communication with the formation fluid 305. In the illustrated example of FIG. 4, the downhole imaging processor 310 could be located on one side of the sample cell and the lighting device(s) 430 could be located on the same side of the sample cell. In such an example, the sample cell includes a substantially transparent window to permit light emitted by the lighting device(s) 330 to pass through the window, contact and be reflected by the formation fluid 305, and sensed by the downhole imaging processor 310.

In some examples, the lighting device(s) 330 and/or 430 of FIGS. 3-4 can correspond to fluorescent lighting sources. In some examples, the lighting device(s) 330 and/or 430 can provide stripe or dot pattern illumination. In some examples, the downhole fluid analyzers 300 and/or 400 can support multiple lighting devices with different angles of lighting and/or combinations of the penetration-type lighting device(s) 330 and the reflection-type lighting device(s) 430. In some examples, the downhole fluid analyzers 300 and/or 400 include a light focusing device (e.g., adjustable lens, mirrors, etc.) positioned and controllable (e.g., by the controller 315) to adjust the light emanating from the lighting device(s) 330 and/or 430.

Figure 5:
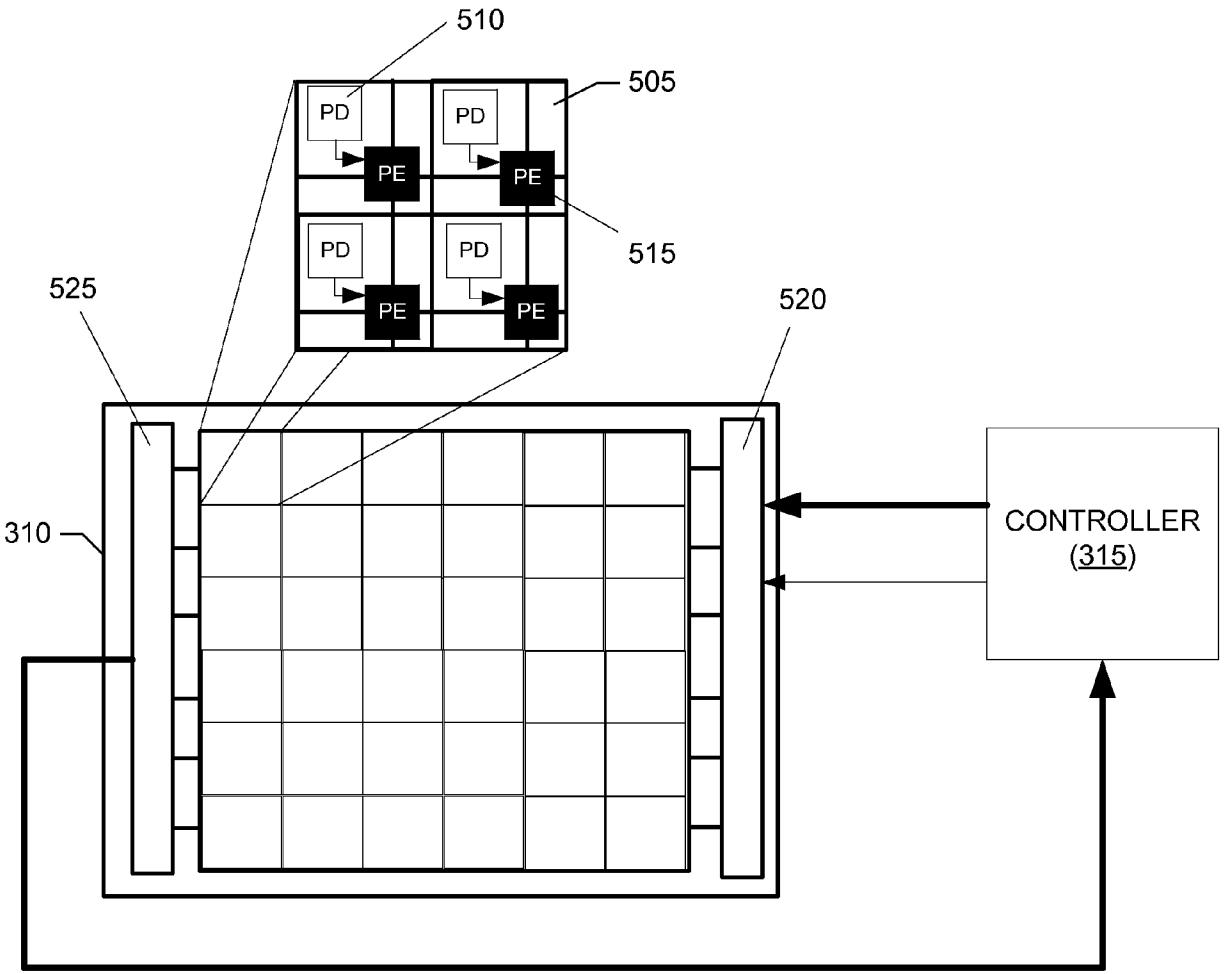
FIG. 5 illustrates a first example imaging processor that may be used to implement the downhole fluid analyzers of FIGS. 3 and/or 4.

FIG. 5 illustrates a first example implementation of the downhole imaging processor 310 described above. In the example of FIG. 5, the downhole imaging processor 310 includes an array of pixel sensors 505. Each example pixel sensor 505 of the downhole imaging processor 310 includes a respective example photo detector (PD) 510 and an associated example processing element (PE) 515. Each PD 510 of the illustrated example determines image data (e.g., such as intensity, color, etc.) for a respective portion (e.g., such as a respective pixel) of an image region supported by the downhole imaging processor 310 as defined by the array of pixel sensors 505. As such, the size of the array of pixel sensors 505 determines the image resolution that can be obtained by the downhole imaging processor 310. For example, the array of pixel sensors 505 can dimensioned to include X rows by Y columns of sensors, where X and Y are chosen to provide a desired image resolution. Example of (X,Y) dimensions for the array of pixel sensors 505 include, but are not limited to, (100,100), (600,400), (800,600) (1024,768), etc., or any other appropriate pair of dimensions.

In the illustrated example, each PE 515 for each pixel sensor 505 of the downhole imaging processor 310 includes an arithmetic and logic unit (ALU) and an internal memory. Additionally, the PE 515 in one cell is connected to and can communicate with the other PEs 515 (referred to herein as neighbor PEs) in the one or more (e.g., such as 4) adjacent, neighbor pixel sensors 505. In some examples, each PE 515 is able to perform arithmetic and logical operations on the image data obtained from the PD 510 in its own pixel sensor 505 and the image data obtained from the other PDs 510 (referred to herein as neighbor PDs 510) in the one or more (e.g., such as 4) adjacent, neighbor cells 505. In such an example, the PE 515 is connected to and can communicate with its own memory (e.g., which stores the image data from the PD 510 in its own cell 505) and the memories of the neighbor PEs 515 (e.g., which store the image data from the neighbor PDs 510).

In the illustrated example, each PE 515 for each pixel sensor 505 is programmable by the controller 315 via any appropriate example decoder circuitry 520. For example, the controller 315 can use the decoder circuitry 520 to send machine-readable instructions to one or more, or all, of the PEs 515. In some examples, the PEs 515 of the downhole imaging processor 310 support parallel processing of the image data in their respective memories and neighbor memories, and the instructions can be single instruction multiple data (SIMD) instructions supporting such parallel processing. In the illustrated example, the processed image data resulting from the processing (e.g., parallel processing) performed by the PEs 515 can be read by or otherwise returned to the controller 315 via any appropriate example output circuitry 525. Further examples of high speed imaging technologies that can be used to implement the downhole imaging processor 310 are described in Masatoshi Ishikawa et al., "A CMOS Vision Chip with SIMD Processing Element Array for 1 ms Image Processing", *IEEE International Solid-State Circuits Conference* (*ISSCC* 1999), Dig. Tech. Papers, pp. 206-207, 1999, which is incorporated herein by reference in its entirety.

In an example operation of the downhole imaging processor 310 and controller 315 of FIG. 5, the controller 315 uses the decoder circuitry 520 to program the PEs 515 of the pixel sensors 505 to cause the PDs 510 of the pixel sensors 505 to sense light that has contacted a formation fluid, such as the formation fluid 305. Each PD 510 processes the sensed light to determine image data, such as image intensity data, image color data, etc., for its respective portion of the image region supported by the downhole imaging processor 310. The image data determined by a particular PD 510 is stored in the memory of the respective PE 515 included in the same pixel sensor 505.

The controller 315 then uses the decoder circuitry 520 to program each PE 515 for each pixel sensor 505 to process the image data stored in its memory (e.g., corresponding to the image data obtained from its associated PD 510) and the image data stored in the memories of the neighbor PEs 515 (e.g., corresponding to the image data obtained from the neighbor PDs 510) to determine object boundary information for one or more objects contained in the formation fluid 305. For example, the ALU of a particular PE 515 can perform operations, such as addition, subtraction, comparison, etc., to process the image data for its pixel sensor 505 and its neighbor pixel sensors 505 to determine whether the portion of the image region corresponding to the particular PE 515 is completely within or outside an object (e.g., of the image data for the entire neighborhood is substantially similar), or is at a boundary of the object (e.g., if the image data differs for different portions of neighborhood). In some examples, the boundary information can use a first value (e.g., 0) to represent pixels sensors determined to correspond to image regions completely within or outside an object, and a second value (e.g., 1) to represent pixel sensors determined to correspond to image regions at an object boundary.

After the PEs 515 determine the object boundary information by processing the image data for their respective neighborhoods, the controller 315 uses the output circuitry 525 to read this object boundary information. The controller 315 can then process the object boundary information to detect object(s) in the formation fluid 305. For example, controller 315 can use any appropriate image processing technique or techniques, such as edge detection, region growing, center of mass computation, etc., to process the object boundary information to determine the location(s) and size(s) of object(s) contained in the formation fluid in the image region supported by the downhole imaging processor 310. Furthermore, the controller 315 can count the number of objects detected in the formation fluid over time. In the illustrated example, the controller 315 determines fluid analysis measurement data including, for example, coordinates (e.g., one, two or three dimensional coordinates) of the location(s) of object(s) detected in the formation fluid 305, size(s) of the object(s) detected in the formation fluid 305, number(s) of object(s) detected in the formation fluid 305 (e.g., over time), etc. The controller 315 then formats the fluid analysis measurement data for transmission to the surface (e.g., to the logging and control unit 140) via the telemetry communication link 320.

In some examples, the downhole imaging processor 310 can provide a raw image formed from the image data obtained from each PD 510 to the controller 315. In examples in which the telemetry communication link 320 supports a sufficiently bandwidth, the controller 315 may send the raw image, and even sequences of raw images (e.g., forming a video stream) to the surface (e.g., to the logging and control unit 140).

Figure 6:
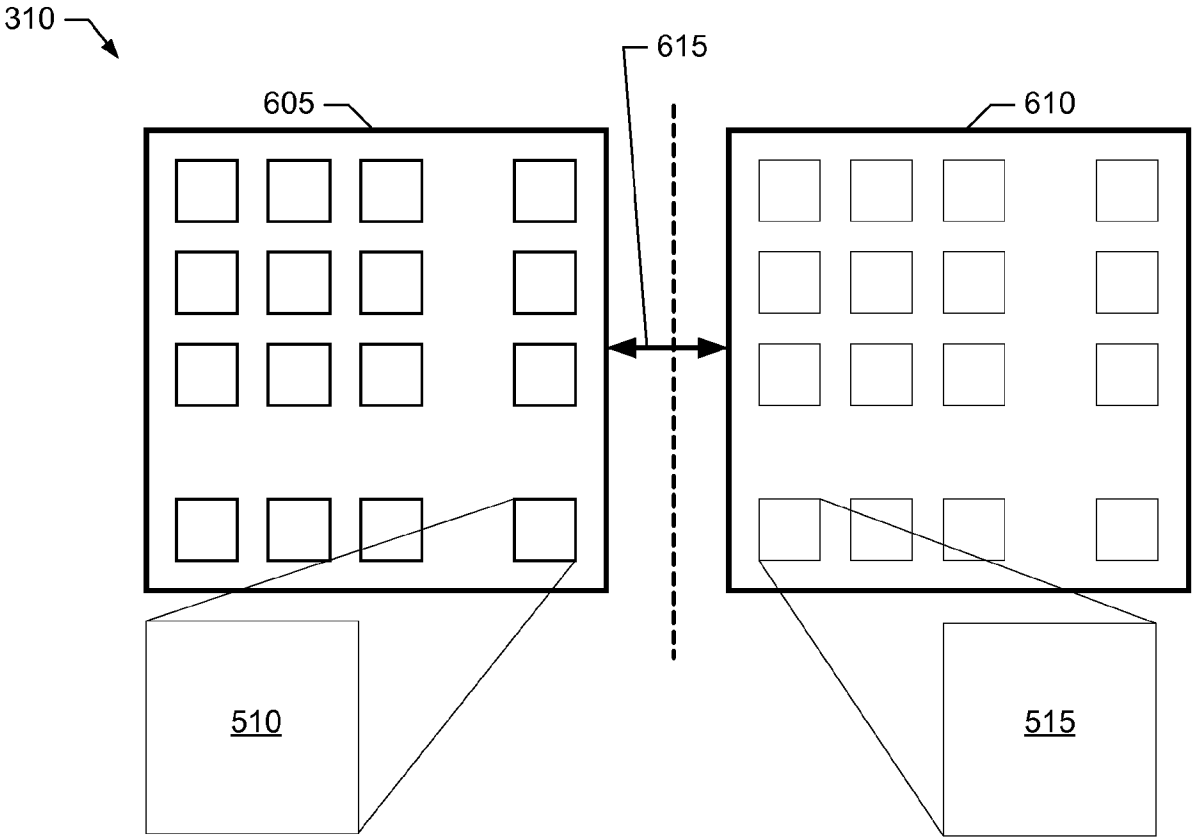
FIG. 6 illustrates a second example imaging processor that may be used to implement the downhole fluid analyzers of FIGS. 3 and/or 4.

A second example implementation of the downhole imaging processor 310 described above is illustrated in FIG. 6. In the example of FIG. 6, the downhole imaging processor 310 includes an example PD array chip 605 containing the PDs 510 for each pixel sensor 505, and a separate example PE array chip 610 containing the PEs 515 for each pixel sensor 505. The PD array chip 605 and the PE array chip 610 are interconnected via an example inter-chip communication link 615, which may be implemented by any type of communication circuitry, bus, etc. In the illustrated example, the PD array chip 605 and the PE array chip 610 are implemented using separate semiconductor devices. For example, the PD array chip 605 can be implemented by a semiconductor device containing complementary metal oxide semiconductor (CMOS) image sensors, and the PE array chip 610 can be implemented by a semiconductor device, such as a field programmable gate array (FPGA) and/or any other device capable of implementing the ALUs and memories making up the PEs 515 included in the PE array chip 610.

In the examples of FIGS. 5-6, the PDs 510 can be implemented using any type or combination of photonic sensors, such as optical sensors, electromagnetic sensors, etc. For example, the PDs can be implemented using CMOS-type photo detectors. As such, the PDs 510 can be used by the downhole imaging processor 310 to detect and process fluorescent characteristics for objects (also referred to herein as targets) in the formation fluid 305 being analyzed. In some examples, the PDs 510 can include compensation circuitry to compensate for noise that occurs during high temperature operation.

Figure 7:
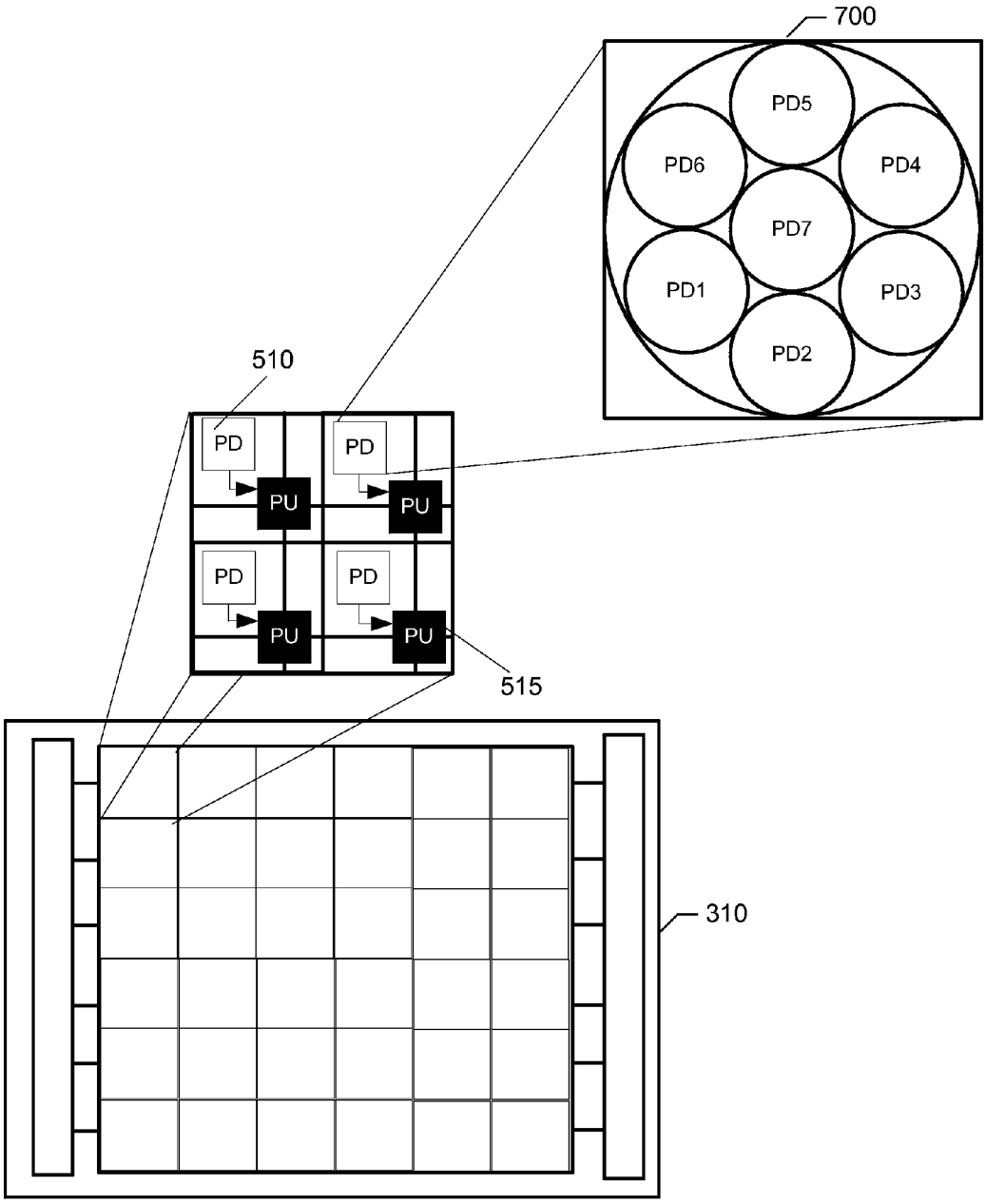
FIG. 7 illustrates an example photo detector that may be used to implement the imaging processors of FIGS. 5 and/or 6.
Figure 8:
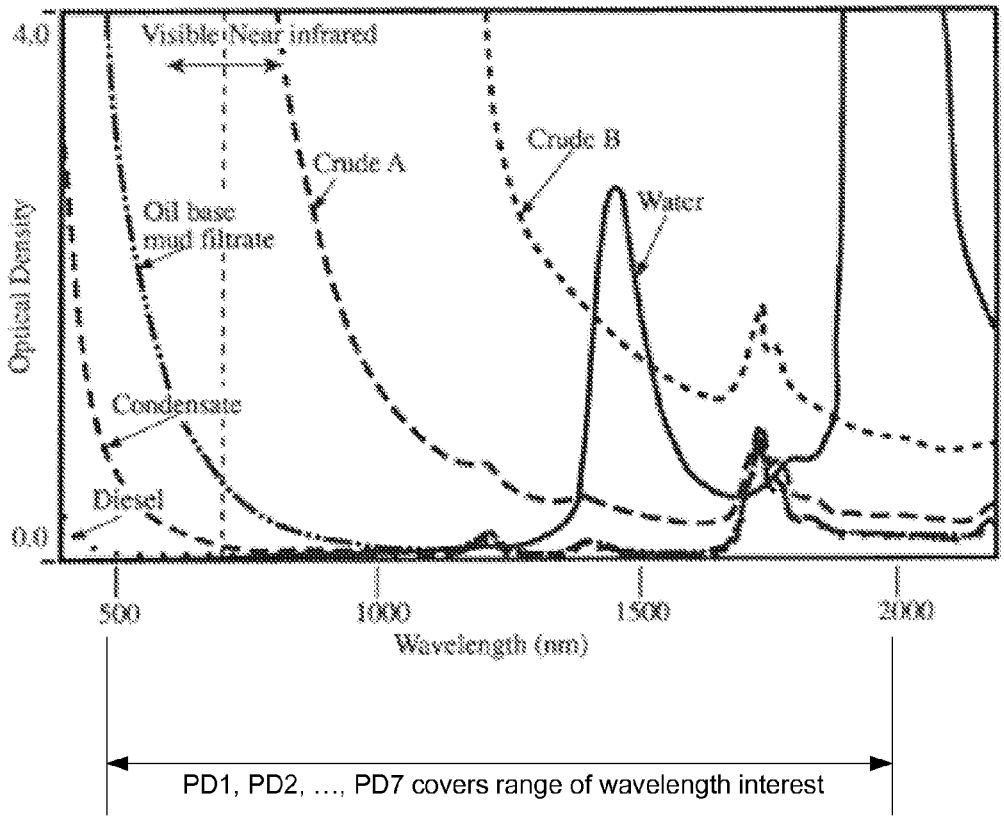
FIG. 8 illustrates example optical characteristics that can be sensed by the photo detector or FIG. 7.

FIG. 7 illustrates another example PD 700 that may be used to implement the PDs 510 included in the example downhole imaging processors 310 of FIGS. 5 and/or 6. The example PD 700 of FIG. 7 includes multiple PD elements PD1-PD7 having different respective sensing characteristics. For example, the PD elements PD1-PD7 can correspond to multiple photo diodes or other photonic sensors having different light wavelength (e.g., color) sensitivities, as illustrated in FIG. 8. As illustrated in FIG. 8, the PD elements PD1-PD7 implementing the PD 700 can be chosen to cover a range of wavelengths of interest based on the type(s) of formation fluid(s) 305 to be analyzed. Although seven PD elements PD1-PD7 are illustrated in the example of FIG. 7, the PD 700 can include more or fewer PD elements as appropriate for a particular implementation.

In some examples, the downhole imaging processor 310 can include one or more light magnification devices (not shown) to boost light intensity provided to the PDs 510 and/or 700 described above. In some examples, the downhole imaging processor 310 can include one or more filters to filter the light provided to the PDs 510 and/or 700. In some examples, such filtering is uniform for all PDs 510 and/or 700 of the downhole imaging processor 310. However, in other examples, such as in the context of the example PD 700 of FIG. 7, different filters can be used for the different PD elements PD1-PD7 implementing the PD 700. For example, each PD element PD1-PD7 may have a respective filter having filter characteristics to pass a range of wavelengths matching the wavelength sensitivity of the particular PD element PD1-PD7. In some examples, the downhole imaging processor 310 can additionally include a grating device to be used with the filter(s) that are to process the light provided to the PDs 510 and/or 700.

Figure 9A:
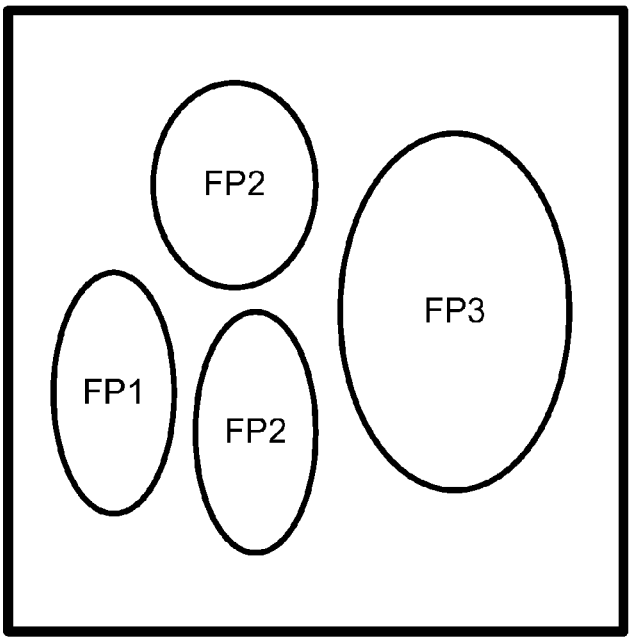
FIGS. 9A-B illustrate example fluid property regions detectable using the downhole fluid analyzers of FIGS. 3 and/or 4.
Figure 9B:
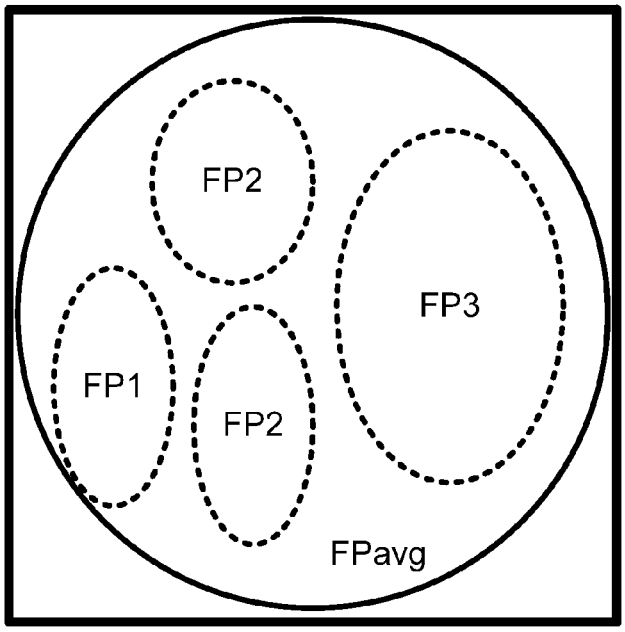

FIGS. 9A-B illustrate further capabilities of the downhole imaging processor 310 and, more generally, the downhole fluid analyzers 300 and 400 described above. The downhole imaging processor 310 disclosed herein can be used to analyze multiple phase fluid, such as fluid containing combinations of water, oil, gas, flowable solids, etc. For example, and as illustrated in the example of FIG. 9A, the downhole imaging processor 310 can provide sufficient image resolution and downhole processing power to analyze and detect different fluid properties FP1-FP4 in different local spatial areas of the fluid being analyzed. In contrast, FIG. 9B illustrates an example fluid property analysis of a multiple phase as obtained from a prior technique described in Smits et al., "In-Situ Optical Fluid Analysis as an Aid to Wireline Formation Sampling", SPE Formation Evaluation, June 1995. In the example of FIG. 9B, the prior technique is limited to detecting just an average fluid property, FPavg, characteristic of the entire analyzed region of the fluid.

Figure 10:
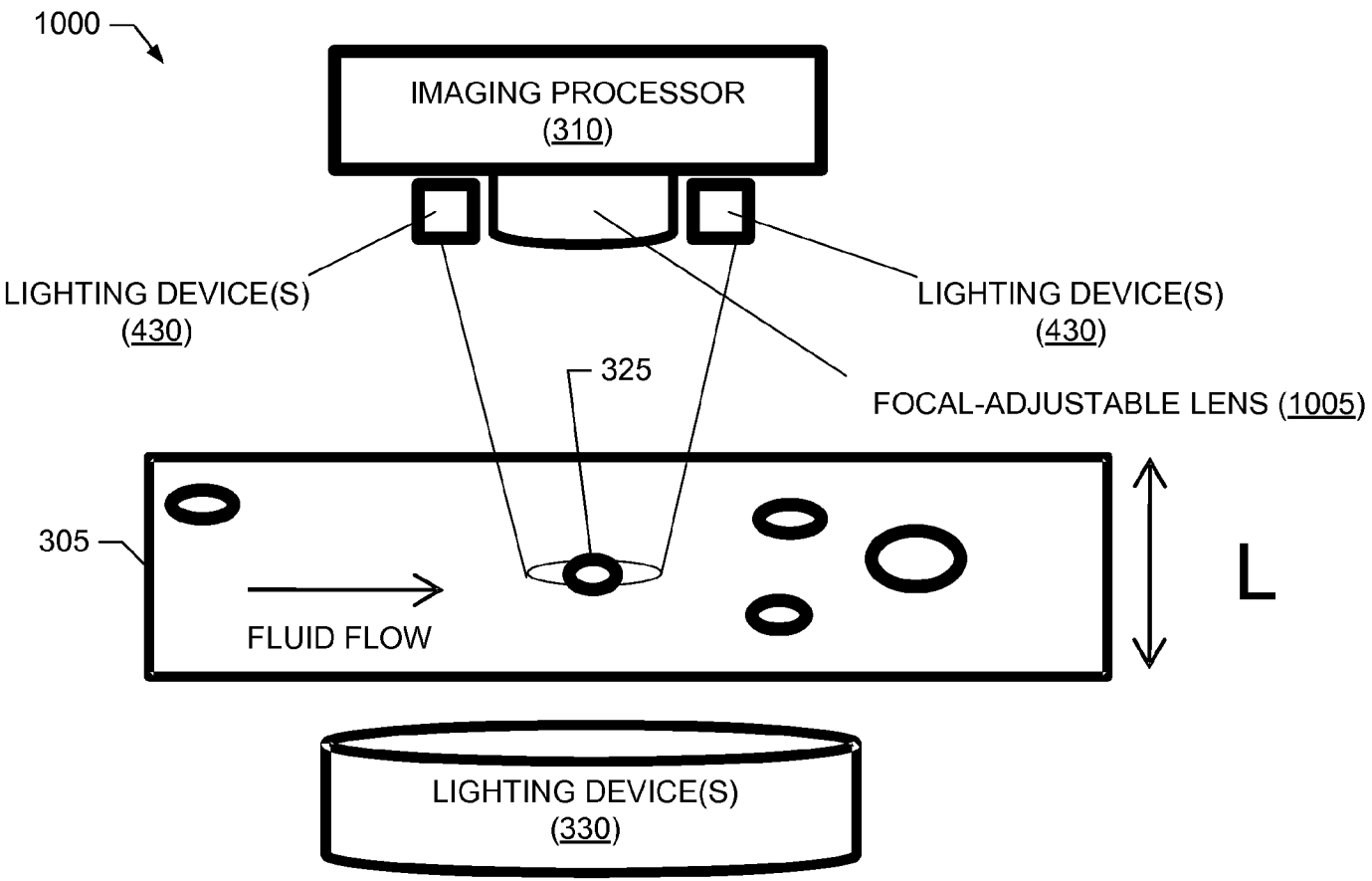
FIG. 10 illustrates a third example downhole fluid analyzer employing an adjustable lens that may be used to perform downhole fluid analysis in the wellsite system of FIG. 1.

A third example downhole fluid analyzer 1000 that may be used to implement imaging-based downhole fluid analysis in the wellsite system 1 in accordance the example methods, systems and articles of manufacture disclosed herein is illustrated in FIG. 10. The third example downhole fluid analyzer 1000 is similar to the second example downhole fluid analyzer 400 of FIG. 4, although some of the elements of FIG. 4 have been removed from FIG. 10 to simplify the drawing. Additionally, the third example downhole fluid analyzer 1000 includes an example lens system 1005 containing a focal-adjustable lens to support tracking (e.g., in real-time and/or in multiple dimensions) of one or more objects (targets) in the formation fluid 305 being analyzed. Although the lens system 1005 is illustrated as having one adjustable lens in the example of FIG. 10, the downhole fluid analyzer 1000 can support a lens system 1005 having multiple adjustable lenses to track multiple objects at different locations/angles, and/or provide increased accuracy and/or response time when tracking a single object.

In some examples, the downhole fluid analyzer 1000 implements one or more self-windowing algorithms, such as the examples described in Ishii et al, "Self Windowing for high speed vision", *Trans. IEICE*, Vol. J82-D-II, No. 12, pp. 2280-2287, 1999, which is incorporated herein by reference in its entirety. In addition, the lens system 1005 can have, but is not limited to, a large dynamic range for field-of-depth (e.g., ranging from shallow focus to deep focus). In some examples, the lens system 1005 can have, but is not limited to, a large dynamic range for field-of-view. A large dynamic field-of-view allows the system to obtain images from a particular angle or for a wide range of field of view. An example implementation of the lens system 1005 is described in Oku et al., "High-speed autofocusing of a cell using diffraction pattern", *Optics Express*, Vol. 14, pp. 3952-3960, 2006, which is incorporated herein by reference in its entirety.

In some examples, the downhole fluid analyzer 1000 implements an automated control loop to adjust the lens of the lens system 1005 to track an object 325 in the formation fluid 305. For example, and as described above, the downhole imaging processor 310 of the downhole fluid analyzer 1000 determines image data for the formation fluid 305 and processes the image data to determine object boundary information. The controller 315 (not shown in FIG. 10) included in the downhole fluid analyzer 1000 processes the object boundary information to determine object location information for the object 325. The controller 315 then uses the determined object location information (e.g., object coordinates) to adjust a focal length and/or an angle of an adjustable lens of the lens system 1005 to track (e.g., using a feedback control loop) the motion of the object 325 in the formation fluid 305. In some examples the controller 315 can adjust an adjustable lens of the lens system 1005 based on commands received from the surface via the telemetry communication link 320 (not shown in FIG. 10), where the commands can be based on object location information reported by the controller 315 via the telemetry communication link 320.

The example downhole fluid analyzers 300, 400 and/or 1000 described above can perform a wide variety of fluid analyses, such as, but not limited to: 1) real-time bubble point detection; 2) simultaneous shown-up detection from multiple bubbles at a time; 3) water/gas holdup measurement, including simultaneous counting of multiple bubble for a production logging application; and/or 4) quantitative image measurement (e.g., fluid color, bubble size/volume, water/gas percentage in oil, etc.). In some examples, the downhole fluid analyzers 300, 400 and/or 1000 include an example dye injector (not shown) to inject and enable tracking of dyes in the fluid 305 (e.g., to measure fluid flow). In some examples, the downhole fluid analyzers 300, 400 and/or 1000 can be used to observe surface conditions of the borehole, surface conditions of the casing, etc. (e.g., by sensing light reflected by the surface of the borehole, casing, etc., where the light has been emitted by a light source positioned to illuminate the surface of the borehole, casing, etc.).

Bubble detection as performed by the downhole fluid analyzers 300, 400 and/or 1000 can include detection of methane hydrates-derived bubbles. The production of methane hydrate generally occurs in a low temperature environment. In this case, the downhole fluid analyzer 300, 400 and/or 1000 can be operated in a low temperature environment without any cooling devices or cooling methods.

Figure 11:
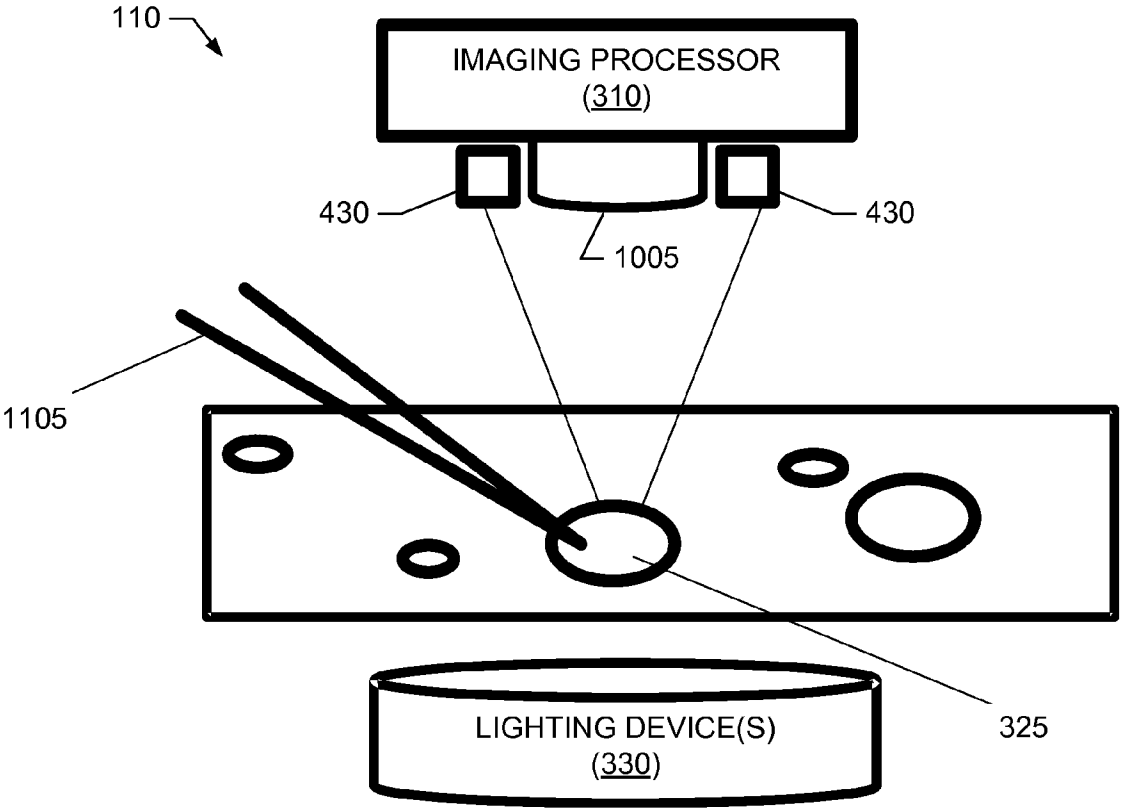
FIG. 11 illustrates a fourth example downhole fluid analyzer employing an example actuator or probe that may be used to perform downhole fluid analysis in the wellsite system of FIG. 1.

A fourth example downhole fluid analyzer 1100 that may be used to implement imaging-based downhole fluid analysis in the wellsite system 1 in accordance the example methods, systems and articles of manufacture disclosed herein is illustrated in FIG. 11. The fourth example downhole fluid analyzer 1100 is similar to the second example downhole fluid analyzer 400 of FIG. 4, although some of the elements of FIG. 4 have been removed from FIG. 11 to simplify the drawing. Additionally, the fourth example downhole fluid analyzer 1100 includes an example probe 1105 to sample the formation fluid (e.g., at a target location) in a downhole borehole, inside a perforation hole, in situ inside a flow line, etc. The probe 1105 may be an example actuator 1105 to permit manipulation of the formation fluid (e.g., at a target location) in a downhole borehole, inside a perforation hole, in situ inside a flow line, etc. Although one probe/actuator 1105 is illustrated in the example of FIG. 11, the downhole fluid analyzer 1100 can include multiple probes/actuators 1105.

In some examples, and as described above, the downhole imaging processor 310 of the downhole fluid analyzer 1100 determines image data for the formation fluid 305 and processes the image data to determine object boundary information. The controller 315 (not shown in FIG. 11) included in the downhole fluid analyzer 1100 processes the object boundary information to determine object location information for the object 325. The controller 315 then uses the determined object location information (e.g., object coordinates) to adjust the probe/actuator 1105 to the location of the object 325 in the formation fluid 305. In some examples, the controller 315 can adjust the probe/actuator 1105 based on commands received from the surface via the telemetry communication link 320 (not shown in FIG. 11), where the commands can be based on object location information reported by the controller 315 via the telemetry communication link 320.

Figure 12:
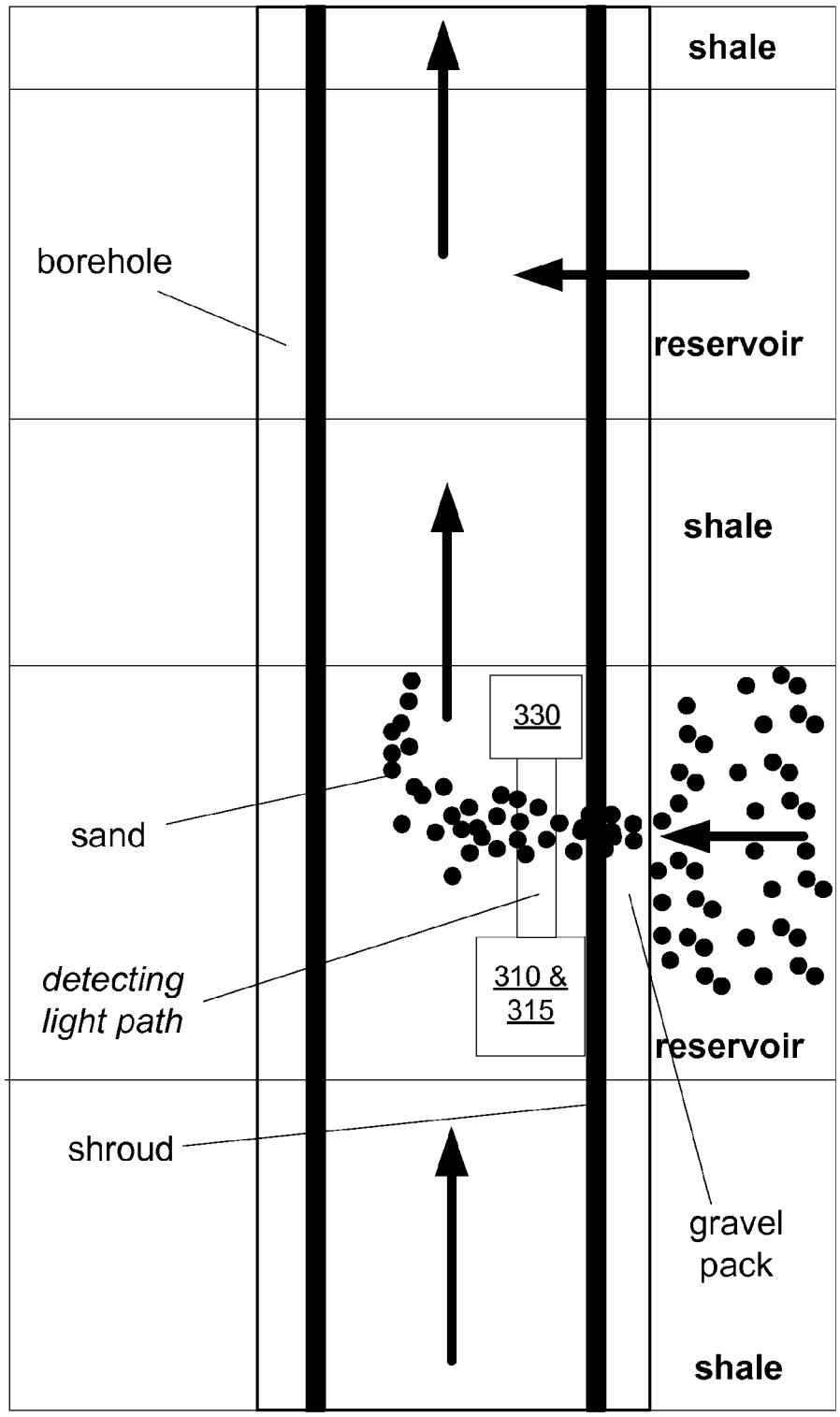
FIG. 12 illustrates an example operation of the first example downhole fluid analyzer of FIG. 3 to perform sand production detection in an example borehole.

FIG. 12 illustrates another example operation of the downhole fluid analyzers 300, 400, 1000 and/or 1100 described above. For convenience, operation of FIG. 12 is described from the perspective of implementation by the downhole fluid analyzer 300. In the illustrated example of FIG. 12, the downhole fluid analyzer 300 is positioned and configured to detect sand production in a drilling environment. For example, using the imaging techniques described above for object location, size and number determination, the downhole fluid analyzer 300 can detect (e.g., in real-time) the size of any sand particles in the formation fluid, and/or the quantity of the particles, to provide early sand production information to an operator. Based on such reported information, one or more preventative steps can be taken to avoid any further sand production that can damage the well.

In some examples, the downhole fluid analyzers 300, 400, 1000 and/or 1100 described above can include one or more cooling devices to reduce and/or maintain analyzer operating temperature. For example, the downhole fluid analyzers 300, 400, 1000 and/or 1100 can include thermal electric cooler(s) to reduce the operating temperature(s) of one or more semiconductor and/or other processing devices used to implement the downhole fluid analyzers 300, 400, 1000 and/or 1100. In some examples, the downhole fluid analyzers 300, 400, 1000 and/or 1100 can use other cooling mechanisms based on heat transfer methods, such as using one or more heat-sinks and/or circulating low temperature fluid around the semiconductor and/or other processing devices implementing the downhole fluid analyzers 300, 400, 1000 and/or 1100.

While example manners of implementing the downhole fluid analyzers 300, 400, 1000 and/or 1100 have been illustrated in FIGS. 3-7, 10 and 11, one or more of the elements, processes and/or devices illustrated in FIGS. 3-7, 10 and/or 11 may be combined, divided, re-arranged, omitted and/or implemented in any other way. Further, the example downhole imaging processor 310, the example controller 315, the example telemetry communication link 320, the example PDs 510 and/or 700, the example PD elements PD1-PD7, the example PEs 515, the example decoder circuitry 520, the example output circuitry 525, the example PD array chip 605, the example PE array chip 610, the example inter-chip communication link 615, the example lens system 1005, the example probe/actuator 1105 and/or, more generally, the example downhole fluid analyzers 300, 400, 1000 and/or 1100 may be implemented by hardware, software, firmware and/or any combination of hardware, software and/or firmware. Thus, for example, any of the example downhole imaging processor 310, the example controller 315, the example telemetry communication link 320, the example PDs 510 and/or 700, the example PD elements PD1-PD7, the example PEs 515, the example decoder circuitry 520, the example output circuitry 525, the example PD array chip 605, the example PE array chip 610, the example inter-chip communication link 615, the example lens system 1005, the example probe/actuator 1105 and/or, more generally, the example downhole fluid analyzers 300, 400, 1000 and/or 1100 could be implemented by one or more circuit(s), programmable processor(s), application specific integrated circuit(s) (ASIC(s)), programmable logic device(s) (PLD(s)) and/or field programmable logic device(s) (FPLD(s)), etc. When any of the appended apparatus claims are read to cover a purely software and/or firmware implementation, at least one of the example downhole fluid analyzers 300, 400, 1000 and/or 1100, the example downhole imaging processor 310, the example controller 315, the example telemetry communication link 320, the example PDs 510 and/or 700, the example PD elements PD1-PD7, the example PEs 515, the example decoder circuitry 520, the example output circuitry 525, the example PD array chip 605, the example PE array chip 610, the example inter-chip communication link 615, the example lens system 1005 and/or the example probe/actuator 1105 are hereby expressly defined to include a tangible computer readable medium such as a memory, digital versatile disk (DVD), compact disk (CD), etc., storing such software and/or firmware. Further still, the example downhole fluid analyzers 300, 400, 1000 and/or 1100 may include one or more elements, processes and/or devices in addition to, or instead of, those illustrated in FIGS. 3-7, 10 and 11, and/or may include more than one of any or all of the illustrated elements, processes and devices.

Figure 13:
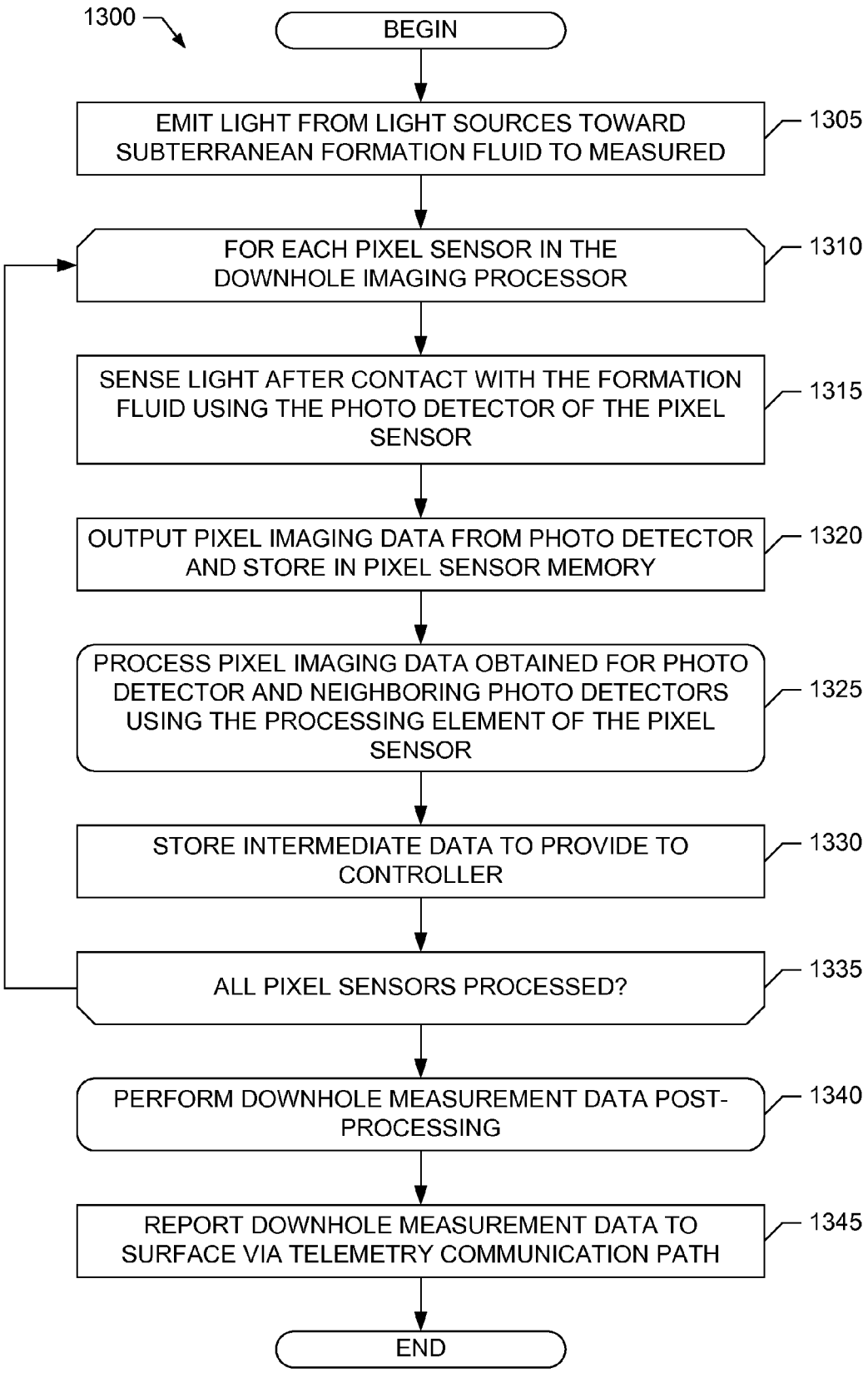
FIG. 13 is a flowchart representative of an example process that may be performed to implement the example downhole fluid analyzers of FIGS. 3, 4, 10 and/or 11.
Figure 14:
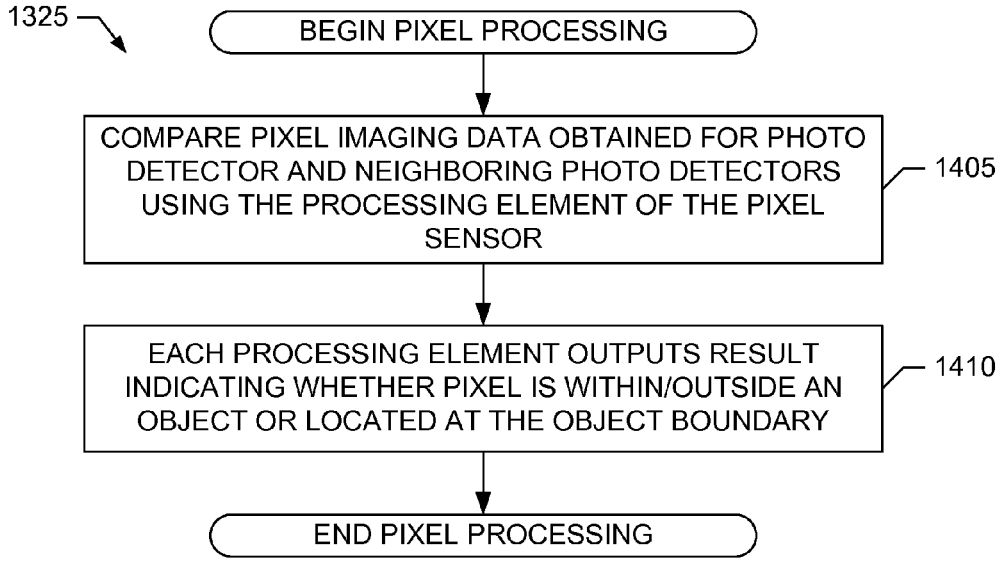
FIG. 14 is a flowchart representative of an example process that may be performed to implement the example imaging processors of FIGS. 5 and/or 6, and or to implement pixel processing in the example process of FIG. 13.
Figure 15:
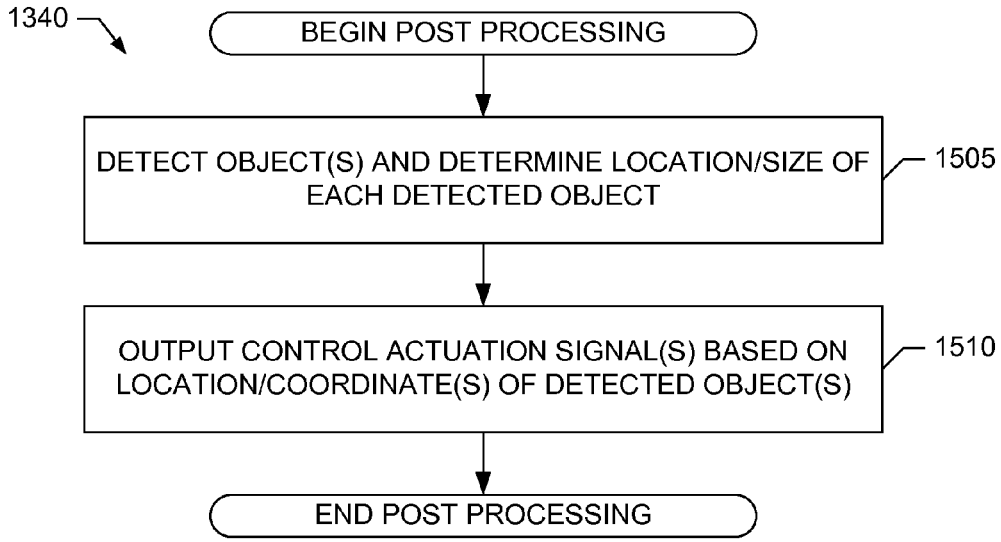
FIG. 15 is a flowchart representative of an example process that may be performed to implement post-processing in the example downhole fluid analyzers of FIGS. 3, 4, 10 and/or 11.

Flowcharts representative of example processes that may be executed to implement the example downhole fluid analyzers 300, 400, 1000 and/or 1100, the example downhole imaging processor 310, the example controller 315, the example telemetry communication link 320, the example PDs 510 and/or 700, the example PD elements PD1-PD7, the example PEs 515, the example decoder circuitry 520, the example output circuitry 525, the example PD array chip 605, the example PE array chip 610, the example inter-chip communication link 615, the example lens system 1005 and/or the example probe/actuator 1105 are shown in FIGS. 13-15. In these examples, the process represented by each flowchart may be implemented by one or more programs comprising machine readable instructions for execution by a processor, such as the processor 1612 shown in the example processing system 1600 discussed below in connection with FIG. 16. In some examples, the entire program or programs and/or portions thereof implementing one or more of the processes represented by the flowcharts of FIGS. 13-15 could be executed by a device other than the processor 1612 (e.g., such as a controller and/or any other suitable device) and/or embodied in firmware or dedicated hardware (e.g., implemented by an ASIC, a PLD, an FPLD, discrete logic, etc.). Also, one or more of the processes represented by the flowchart of FIGS. 13-15, or one or more portion(s) thereof, may be implemented manually. Further, although the example processes are described with reference to the flowcharts illustrated in FIGS. 13-15, many other techniques for implementing the example methods and apparatus described herein may be used. For example, with reference to the flowcharts illustrated in FIGS. 13-15, the order of execution of the blocks may be changed, and/or some of the blocks described may be changed, omitted, combined and/or subdivided into multiple blocks.

As mentioned above, the example processes of FIGS. 13-15 may be implemented using coded instructions (e.g., computer readable instructions) stored on a tangible computer readable medium such as a hard disk drive, a flash memory, a read-only memory (ROM), a CD, a DVD, a cache, a random-access memory (RAM) and/or any other storage media in which information is stored for any duration (e.g., for extended time periods, permanently, brief instances, for temporarily buffering, and/or for caching of the information). As used herein, the term tangible computer readable medium is expressly defined to include any type of computer readable storage and to exclude propagating signals. The example processes of FIGS. 13-15 may be implemented using coded instructions (e.g., computer readable instructions) stored on a non-transitory computer readable medium, such as a flash memory, a ROM, a CD, a DVD, a cache, a random-access memory (RAM) and/or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals. Also, as used herein, the terms "computer readable" and "machine readable" are considered equivalent unless indicated otherwise.

An example process 1300 that may be executed to implement one or more of the example downhole fluid analyzers 300, 400, 1000 and/or 1100 of FIGS. 3. 4, 10 and/or 11 is illustrated in FIG. 13. For convenience, and without loss of generality, operation of the example process 1300 is described in the context of execution by the downhole fluid analyzer 300 of FIG. 3. With reference to the preceding figures and associated descriptions, the process 1300 begins execution at block 1305 at which the light device(s) 330 of the downhole fluid analyzer 300 emit light that is to contact (e.g., and pass-through and/or be reflected by) the formation fluid 305 being analyzed.

Next, at block 1310, each pixel sensor 505 in the downhole imaging processor 310 of the downhole fluid analyzer 300 operates as follows. At block 1315, the PD 510 in each pixel sensor 505 is to sense the light emitted at block 1305 after having contacted with the formation fluid. At block 1320, the PD 510 of each pixel sensor 505 outputs image data (e.g., intensity, color, etc.) based on the sensed light and stores the image data in the memory of the respective PE 515 associated with the particular PD 510. At block 1325, the PE 515 of each pixel sensor 505 processes the image data obtained by its associated PD 510 and its adjacent neighbor PDs 510, as described above. For example, at block 1325, the PE 515 of each pixel sensor 505 can determine object boundary information for its portion of the image region supported by the downhole fluid analyzer 300 by processing the image data obtained from its memory and the memories of its neighbor pixel sensors 505, as described above. At block 1330, the downhole imaging processor 310 stores the intermediate data determined by the PE 515 of each pixel sensor 505 for retrieval by the controller 315 of the downhole fluid analyzer 300. At block 1335, processing continues until all pixel sensors 505 have completed their respective processing. Although the processing performed by blocks 1310-1335 is depicted as being serial processing in the example of FIG. 13, the processing performed by blocks 1310-1335 can be parallel processing, as described above, or a combination of parallel and serial processing.

At block 1340, the controller 315 of the downhole fluid analyzer 300 retrieves the intermediate data determined by the downhole imaging processor 310 and post-processes the intermediate data to determine downhole measurement data for reporting to the surface. For example, the controller 315 can process object boundary intermediate data determined by the downhole imaging processor 310 to determine fluid analysis measurement data including location(s) and/or size(s) of object(s) 325 in the formation fluid 305, number(s) of object(s) 325 in the formation fluid 305, etc., as described above. The controller 315 can also format the resulting measurement data for transmission via the telemetry communication link 320, as described above. At block 1345, the controller 315 reports the measurement data determined at block 1340 to the surface (e.g., to the logging and control unit 140) via the telemetry communication link 320.

An example process 1325 that can be used to implement the processing at block 1325 of FIG. 13 and/or pixel sensor processing in the downhole imaging processor 310 is illustrated in FIG. 14. With reference to the preceding figures and associated descriptions, the process 1325 of FIG. 14 begins execution at block 1405 at which the PE 515 in each pixel sensor 505 of the downhole imaging processor 310 compares image data obtained from its associated PD 510 with image data obtained from the PDs 510 of the adjacent neighbor pixel sensors 505. For example, if the PE 515 in a particular pixel sensor 505 determines that the image data obtained from its associated PD 510 is substantially similar to the image data obtained from the PDs 510 of the adjacent neighbor pixel sensors 505, then the PE 515 in the particular pixel sensor 505 can further determine that its pixel sensor 505 is associated with an image pixel that is either entirely within or outside an object in the formation fluid 305 being analyzed. However, if the PE 515 in a particular pixel sensor 505 determines that the image data obtained from its associated PD 510 is substantially different from image data obtained from the PDs 510 of one or more adjacent neighbor pixel sensors 505, then the PE 515 in the particular pixel sensor 505 can further determine that its pixel sensor 505 is associated with an image pixel that is at a boundary of an object in the formation fluid 305 being analyzed.

At block 1410, the PE 515 in each pixel sensor 505 outputs an intermediate result indicating whether the image pixel associated with the pixel sensor 5045 is located at a boundary of an object, or the image pixel is located entirely within or outside an object (or, in other words, is not at a boundary of an object). For example, the PE 515 can use a first value to indicate that it is associated with an image pixel at an object boundary, and a second value to indicate that it is associated with an image pixel that is not at an object boundary.

An example process 1340 that can be used to implement the processing at block 1340 of FIG. 13 and/or post-processing in the controller 315 is illustrated in FIG. 15. With reference to the preceding figures and associated descriptions, the process 1340 of FIG. 15 begins execution at block 1505 at which the controller 315 processes intermediate data (e.g., object boundary information) obtained from the downhole imaging processor 310 to detect object(s) in the formation fluid 305 being analyzed, and the location(s) and size(s) of the detected object(s), as described above. At block 1510, the controller 315 outputs control actuation signal(s) based on the object location information determined at block 1505. For example, and as described above, the controller 315 can output control signals to adjust an adjustable lens included in the lens system of the downhole fluid analyzer 1000, and/or control the probe/actuator 1105 included in the downhole fluid analyzer 1100.

Figure 16:
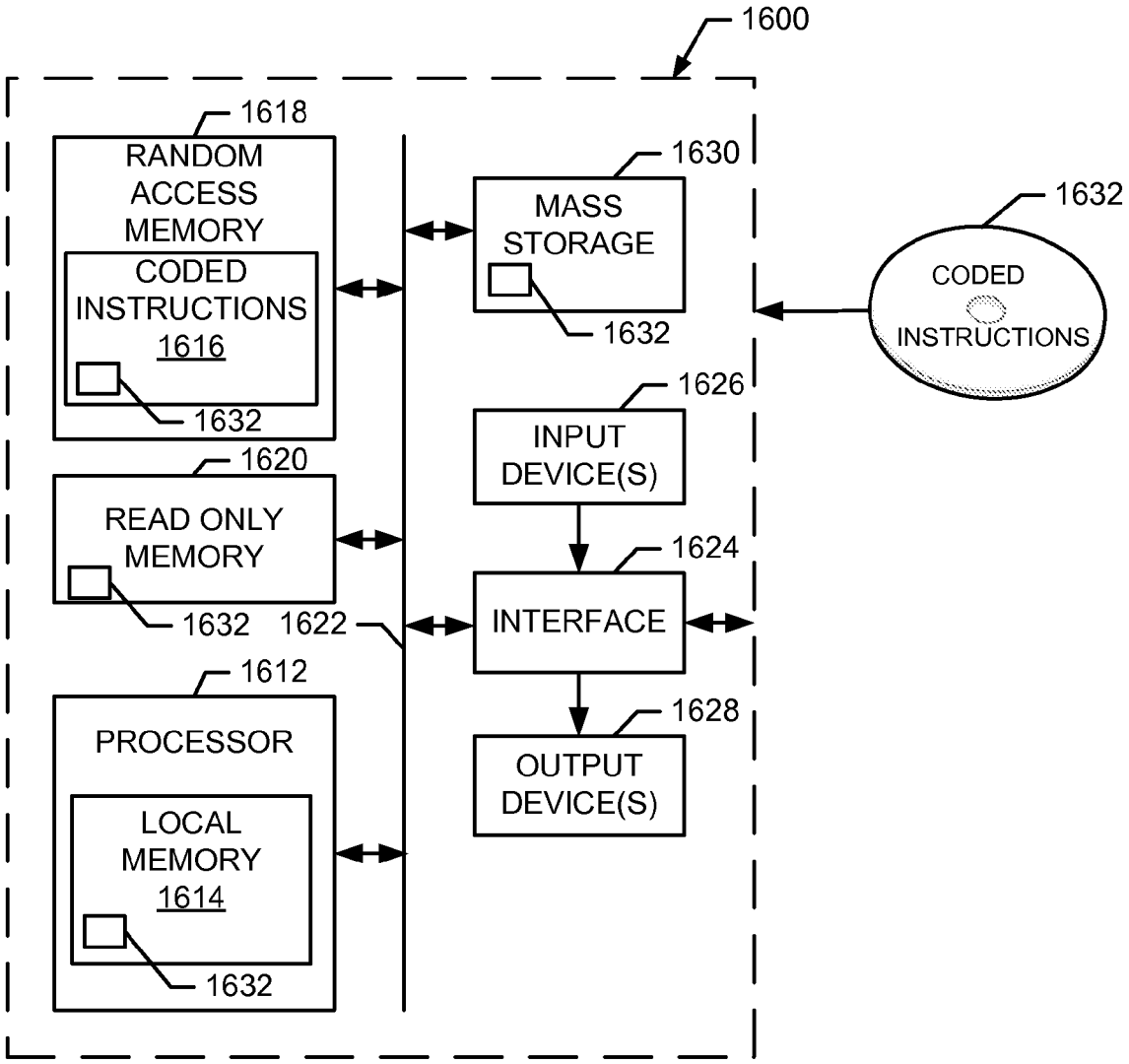
FIG. 16 is a block diagram of an example processing system that may execute example machine readable instructions used to implement one or more of the processes of FIGS. 13, 14 and/or 15 to implement the example downhole fluid analyzers of FIGS. 3, 4, 10 and/or 11, and/or the example imaging processors of FIGS. 5 and/or 6.

FIG. 16 is a block diagram of an example processing system 1600 capable of implementing the apparatus and methods disclosed herein. The processing system 1600 can be, for example, a smart controller, a special-purpose computing device, a server, a personal computer, a personal digital assistant (PDA), a smartphone, an Internet appliance, etc., or any other type of computing device.

The system 1600 of the instant example includes a processor 1612 such as a general purpose programmable processor. The processor 1612 includes a local memory 1614, and executes coded instructions 1616 present in the local memory 1614 and/or in another memory device. The processor 1612 may execute, among other things, machine readable instructions to implement the processes represented in FIGS. 13-15. The processor 1612 may be any type of processing unit, such as one or more Intel® microprocessors from the Pentium® family, the Itanium® family and/or the XScale® family, one or more microcontrollers from the ARM® and/or PICO families of microcontrollers, one or more embedded soft/hard processors in one or more FPGAs, etc. Of course, other processors from other families are also appropriate.

The processor 1612 is in communication with a main memory including a volatile memory 1618 and a non-volatile memory 1620 via a bus 1622. The volatile memory 1618 may be implemented by Static Random Access Memory (SRAM), Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1620 may be implemented by flash memory and/or any other desired type of memory device. Access to the main memory 1618, 1620 may be controlled by a memory controller (not shown).

The processing system 1600 also includes an interface circuit 1624. The interface circuit 1624 may be implemented by any type of interface standard, such as an Ethernet interface, a universal serial bus (USB), and/or a third generation input/output (3GIO) interface.

One or more input devices 1626 are connected to the interface circuit 1624. The input device(s) 1626 permit a user to enter data and commands into the processor 1612. The input device(s) can be implemented by, for example, a keyboard, a mouse, a touchscreen, a track-pad, a trackball, an isopoint and/or a voice recognition system.

One or more output devices 1628 are also connected to the interface circuit 1624. The output devices 1628 can be implemented, for example, by display devices (e.g., a liquid crystal display, a cathode ray tube display (CRT)), by a printer and/or by speakers. The interface circuit 1624, thus, may include a graphics driver card.

The interface circuit 1624 also includes a communication device such as a modem or network interface card to facilitate exchange of data with external computers via a network (e.g., an Ethernet connection, a digital subscriber line (DSL), a telephone line, coaxial cable, a cellular telephone system, etc.).

The processing system 1600 also includes one or more mass storage devices 1630 for storing machine readable instructions and data. Examples of such mass storage devices 1630 include floppy disk drives, hard drive disks, compact disk drives and digital versatile disk (DVD) drives.

The coded instructions 1632 of FIGS. 13-15 may be stored in the mass storage device 1630, in the volatile memory 1618, in the non-volatile memory 1620, in the local memory 1614 and/or on a removable storage medium, such as a CD or DVD 1632.

As an alternative to implementing the methods and/or apparatus described herein in a system such as the processing system of FIG. 16, the methods and or apparatus described herein may be embedded in a structure such as a processor and/or an ASIC (application specific integrated circuit).

Although a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

Finally, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A system to perform downhole fluid analysis, the system comprising:

an imaging processor to be positioned downhole in a geological formation, the imaging processor comprising:

a plurality of photo detectors to sense light that has contacted a formation fluid in the geological formation, each photo detector to determine respective image data for a respective portion of an image region supported by imaging processor; and a plurality of processing elements, each processing element being associated with a respective photo detector and to process first image data obtained from the respective photo detector and second image data obtained from at least one neighbor photo detector; and a controller to report measurement data via a telemetry communication link to a receiver to be located outside the geological formation, the measurement data being based on processed data obtained from the plurality of processing elements.

2. A system as defined in claim 1 further comprising a light source to emit the light to be sensed by the plurality of photo detectors, the light source being positioned to cause the light to pass through the formation fluid.

3. A system as defined in claim 1 further comprising a light source to emit the light to be sensed by the plurality of photo detectors, the light source being positioned to cause the light to be reflected by the formation fluid.

4. A system as defined in claim 1 further comprising a light source to emit the light to be sensed by the plurality of photo detectors, the light source being controllable to change an emission angle of the light.

5. A system as defined in claim 1 wherein a first photo detector of plurality of photo detectors includes a plurality of photo detector elements having different respective sensing characteristics.

6. A system as defined in claim 5 further comprising a plurality of optical filters associated respectively with the plurality of photo detector elements and having different respective filtering characteristics corresponding to the different respective sensing characteristics of the plurality of photo detector elements.

7. A system as defined in claim 6 wherein a first one of the plurality of optical filters comprises an optical grating.

8. A system as defined in claim 1 wherein a first one of the plurality of processing elements comprises:

a first memory to store image data obtained from a first photo detector associated with the first one of the plurality of processing elements; and an arithmetic logic unit in communication with the first memory and a plurality of neighbor memories associated respectively with a subset of the plurality of processing elements that neighbor the first one of the plurality of processing elements.

9. A system as defined in claim 1 wherein the plurality of processing elements are to process the respective image data obtained from each one of the plurality of photo detectors substantially in parallel.

10. A system as defined in claim 1 wherein the imaging processor comprises:

a first semiconductor device to implement the plurality of photo detectors;

a second semiconductor device to implement the plurality of processing elements; and a communication interface to communicatively couple the first semiconductor device and the second semiconductor device.

11. A system as defined in claim 1 wherein the plurality of processing elements are to process the respective image data obtained from each one of the plurality of photo detectors to determine object boundary information for an object in the formation fluid.

12. A system as defined in claim 11 wherein the object comprises at least one of a bubble or a sand particle.

13. A system as defined in claim 11 wherein the controller is to process the object boundary information obtained from the plurality of processing elements to determine a number of objects in the formation fluid.

14. A system as defined in claim 11 wherein the controller is to process the object boundary information obtained from the plurality of processing elements to determine location information representing a location of the object in the formation fluid.

15. A system as defined in claim 14 further comprising an adjustable lens to focus the light prior to being sensed by the plurality of photo detectors, wherein the controller is to process the location information to adjust at least one of a focal length or an angle of the adjustable lens to track motion of the object in the formation fluid.

16. A system as defined in claim 14 further comprising an actuator, wherein the controller is to control the actuator based on the location information.

17. A system as defined in claim 1 further comprising:

a sample cell positionable to be in fluid communication with the formation fluid, the sample cell including a first substantially transparent window; and a light source to irradiate the formation fluid through the first substantially transparent window, wherein the plurality of photo detectors are to sense the light that has contacted the formation fluid through at least one of the first substantially transparent window or a second substantially transparent window.

18. A system as defined in claim 1 wherein the formation fluid comprises at least one of water, oil, gas or a flowable solid material.

19. A method for performing downhole fluid analysis, the method comprising:

sensing light that has contacted a formation fluid in a geological formation using a plurality of photo detectors positioned downhole in the geological formation, each photo detector determining respective image data for a respective portion of an image region defined by the plurality of photo detectors;

processing the image data determined by the plurality of photo detectors using a plurality of processing elements positioned downhole in the geological formation, each processing element processing first image data obtained from a respective photo detector associated with the processing element and second image data obtained from at least one neighbor photo detector; and sending measurement data via a telemetry communication link to a receiver located outside the geological formation, the measurement data being based on processed data obtained from the plurality of processing elements.

20. A method as defined in claim 19 further comprising emitting the light from a light source positioned to cause the light to at least one of pass through or be reflected by the formation fluid.

21. A method as defined in claim 19 wherein processing the image data using the plurality of processing elements comprises processing the respective image data obtained from each one of the plurality of photo detectors to determine object boundary information for an object in the formation fluid.

22. A method as defined in claim 21 further comprising processing the object boundary information to determine at least one of a number of objects in the formation fluid or location information representing a location of the object in the formation fluid.

23. A method as defined in claim 22 further comprising processing the location information to adjust at least one of a focal length or an angle of an adjustable lens to track motion of the object in the formation fluid.

24. A method as defined in claim 22 further comprising controlling an actuator based on the location information.

25. A tangible, non-transitory article of manufacture storing machine readable instructions which, when executed, cause a machine to at least:

sense light that has contacted a formation fluid in a geological formation using a plurality of photo detectors positioned downhole in the geological formation, each photo detector to determine respective image data for a respective portion of an image region defined by the plurality of photo detectors;

process the image data determined by the plurality of photo detectors using a plurality of processing elements positioned downhole in the geological formation, each processing element to process first image data obtained from a respective photo detector associated with the processing element and second image data obtained from at least one neighbor photo detector; and send measurement data via a telemetry communication link to a receiver located outside the geological formation, the measurement data being based on processed data obtained from the plurality of processing elements.

26. A tangible, non-transitory article of manufacture as defined in claim 25 wherein the machine readable instructions, when executed, further cause the machine to emit the light from a light source positioned to cause the light to at least one of pass through or be reflected by the formation fluid.

27. A tangible, non-transitory article of manufacture as defined in claim 25 wherein the machine readable instructions, when executed, further cause the machine to process the respective image data obtained from each one of the plurality of photo detectors to determine object boundary information for an object in the formation fluid.

28. A tangible, non-transitory article of manufacture as defined in claim 27 wherein the machine readable instructions, when executed, further cause the machine to process the object boundary information to determine at least one of a number of objects in the formation fluid or location information representing a location of the object in the formation fluid.

29. A tangible, non-transitory article of manufacture as defined in claim 28 wherein the machine readable instructions, when executed, further cause the machine to process the location information to adjust at least one of a focal length or an angle of an adjustable lens to track motion of the object in the formation fluid.

30. A tangible, non-transitory article of manufacture as defined in claim 28 wherein the machine readable instructions, when executed, further cause the machine to control an actuator based on the location information.

* * * * *